US007693441B2

(12) United States Patent
Nishikawa

(10) Patent No.: US 7,693,441 B2
(45) Date of Patent: Apr. 6, 2010

(54) IMAGE FORMING APPARATUS INCLUDING A TONER REMOVING DEVICE OPERABLE IN TWO MODES FOR REMOVING RESIDUAL TONER ON AN INTERMEDIATE TRANSFER MEMBER

(75) Inventor: Akihiro Nishikawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 14 days.

(21) Appl. No.: 12/146,760

(22) Filed: Jun. 26, 2008

(65) Prior Publication Data

US 2008/0267652 A1 Oct. 30, 2008

Related U.S. Application Data

(63) Continuation of application No. 11/242,537, filed on Oct. 4, 2005, now Pat. No. 7,395,004.

(30) Foreign Application Priority Data

Oct. 20, 2004 (JP) ..... 2004-306263

(51) Int. Cl.
*G03G 15/20* (2006.01)

(52) U.S. Cl. ..... 399/71; 399/101; 399/299; 399/300; 399/302; 399/306; 399/308

(58) Field of Classification Search ..... 399/71, 399/101, 299, 300, 302, 306, 308
See application file for complete search history.

(56) References Cited

U.S. PATENT DOCUMENTS 6,405,002 B2 6/2002 Ogiyama et al.

FOREIGN PATENT DOCUMENTS

JP 6-175432 6/1994

JP 8-272230 10/1996

(Continued)

OTHER PUBLICATIONS

Electronic translation of JP 2002-202403 A.

*Primary Examiner*—David M Gray
*Assistant Examiner*—Ryan D Walsh
(74) *Attorney, Agent, or Firm*—Fitzpatrick, Cella, Harper & Scinto

(57) ABSTRACT

An image forming apparatus including a plurality of image bearing members, an electrostatic image forming device for forming an electrostatic image on the image bearing members, a plurality of developing devices for developing as developer images the electrostatic images formed on the plurality of image bearing members by using developer charged to a predetermined polarity, a primary transferring device for primarily transferring the developer images borne by the plurality of image bearing members to an intermediate transfer member at a plurality of primary transfer portions, a secondary transferring device for secondarily transferring the developer images primarily transferred to the intermediate transfer member to a recording material at a secondary transfer portion, a cleaning device for cleaning the developer on the intermediate transfer member, and a controlling device for, when a secondary untransferred developer image, which is a developer image that has not been secondarily transferred after the primary transfer, is cleaned from the intermediate transfer member, variably controlling a cleaning condition of the cleaning device in accordance with one of an image ratio and a position of the secondary untransferred developer image.

6 Claims, 18 Drawing Sheets

FOREIGN PATENT DOCUMENTS

| | | |
|---|---|---|
| JP | 9-251249 | 9/1997 |
| JP | 10-49019 | 2/1998 |
| JP | 2000-147917 | 5/2000 |
| JP | 3236442 | 9/2001 |
| JP | 2001-305878 | 11/2001 |
| JP | 2002-207403 | 7/2002 |
| JP | 2003-66735 | 3/2003 |

IMAGE FORMING APPARATUS INCLUDING A TONER REMOVING DEVICE OPERABLE IN TWO MODES FOR REMOVING RESIDUAL TONER ON AN INTERMEDIATE TRANSFER MEMBER

This application is a continuation of U.S. patent application Ser. No. 11/242,537, filed Oct. 4, 2005.

BACKGROUND OF THE INVENTION

1. Field of the Invention

The present invention generally relates to an image forming apparatus, such as a copying machine, a printer, or a facsimile, which adopts an electrophotographic printing method, and more particularly to a color image forming apparatus including an intermediate transfer member cleaning apparatus for cleaning an intermediate transfer member on which a multi-color image is formed by superimposedly transferring images formed on image bearing members.

2. Related Background Art

In recent years, as an image forming apparatus that forms an image using an electrophotographic printing method, for instance, an image forming apparatus using an intermediate transfer member that first forms a multi-color image by superimposedly transferring images formed on image bearing members onto the intermediate transfer member and then transfers the multi-color image from the intermediate transfer member to a recording material has been widely used because of needs for formation of high-quality images on various kinds of paper as recording materials.

As the intermediate transfer member, an intermediate transfer belt is widely used. Also, as the intermediate transfer belt, a belt made of a resin generally represented by polyimide or the like is widely used because of its characteristics of realizing high image quality, long life span, and high stability. Further, as belt cleaning means for cleaning the intermediate transfer belt after transfer of a multi-color image onto a recording material, a blade method disclosed in JP 2001-305878 A is widely used. Considering the surface property of the resin belt and the like, the cleaning means based on the blade method has a high cleaning capability.

Meanwhile, recently, in order to further improve image quality and stabilize the cleaning capability of the cleaning means based on the blade method, for instance, diameters of developers (toner) have been reduced and shapes of the toners have been changed into nonspherical shapes.

As a result of the changes of the toner, however, with the intermediate transfer belt made of a resin, a problematic hollow characters phenomenon occurs at the time of transfer. The hollow characters phenomenon is a phenomenon in which at the time of transfer of an image, toner deformation by stress occurs due to application of a high pressure to the image and therefore a cohesive force between toners is increased and a part of the image is not transferred and remain on an image bearing member. The phenomenon occurs particularly conspicuously in the case of transferring letters, line images, and the like. In the case of the resin belt, the pressure applied to images at the time of transfer is very high, so the hollow characters phenomenon becomes particularly problematic.

Therefore, in recent years, in order to solve the hollow characters problem, an elastic intermediate transfer belt having a layer structure including at least one elastic layer has become a mainstream in place of the intermediate transfer belt formed by using a resin.

It is known that the elastic intermediate transfer belt is effective in solving the hollow characters problem because it includes at least one elastic layer in its layer construction and therefore is soft and is capable of reducing a pressure exerted on toner at a transfer portion. It is also known that the elastic intermediate transfer belt is effective not only in improving transfer efficiency with respect to general paper but also in improving a transfer property with respect to thick paper and a transfer property with respect to paper having projections and depressions on its surface due to its superior adhesiveness with paper as a recording material at a secondary transfer portion.

However, when the blade method described above is used to clean the elastic intermediate transfer belt, a contact load of the cleaning blade with respect to the elastic intermediate transfer belt is increased due to elasticity of the surface layer of the elastic intermediate transfer belt, the tip of the edge of the cleaning blade bites into the belt surface layer, and behavior of the tip of the edge of the cleaning blade becomes unstable, which leads to a cleaning failure. In addition, there is a fear that a problem such as a wire edge, flutter, or noise of the cleaning blade, and an inconvenience, such as a flaw in the elastic belt surface layer, or toner fusion bond will occur due to an increased frictional force between the belt and the cleaning blade, which lowers image quality.

Therefore, in recent years, in order to circumvent the inconvenience described above, an electrostatic fur brush with a less contact load with respect to the elastic intermediate transfer belt has been generally used as the cleaning means for cleaning the elastic intermediate transfer belt.

For instance, there is an electrostatic fur brush method described in JP 3236442 B with which a cylindrical member obtained by winding a conductive fiber around a metal core is abutted to a belt under a state in which a bias is applied, and a bias whose polarity is opposite to the polarity of toner is applied, thereby electrostatically attracting the toner with a fur brush and removing the toner from an image bearing member.

It is known that as compared with the blade method, with which toner is mechanically removed, the fur brush method, with which toner is electrostatically attracted and is removed from a belt, has limitations on a cleanable toner amount and toner polarity. With the electrostatic fur brush method, it is impossible to achieve the inherent effect of the fur brush unless toner is electrostatically attracted by the fur brush and then is further transferred from the fur brush using a flicker, a bias applying roller, or the like, so when the amount of toner attracted by the fur brush increases, cleaning performance deteriorates, which means that the electrostatic fur brush method is generally inferior to the blade method in terms of cleanable amount.

Also, as described above, the fur brush method is a method with which toner is cleaned through attraction by a fur brush, so only toner having a polarity that is opposite to the polarity of a bias applied to the fur brush is cleaned.

However, depending on the value of the bias applied at the time of transfer, there is a case where the polarity of transfer residual toner that remains on an intermediate transfer belt after transfer of a toner image to paper is reversed from positive to negative or from negative to positive. The transfer residual toner, whose polarity has been reversed, has the same polarity as the bias applied to the fur brush, so the toner is not attracted by the fur brush and passes through the fur brush. The toner having passed through the fur brush is superimposed on the next image, which may cause an image defect. Therefore, as disclosed in JP 2002-207403 A, two fur brushes are used as cleaning means and biases having different polarities are respectively applied to the fur brushes, thereby making it possible to attract and remove toner with the fur brushes with reliability regardless of the polarity (either positive or negative) to which the toner has been charged due to a bias applied at a secondary transfer portion, a use environment, toner degradation, and the like.

However, in the image forming apparatus described above, when a toner image on an intermediate transfer member is not appropriately transferred to a recording material due to occurrence of a paper jam, a large amount of toner remains on the intermediate transfer member. In order to remove the large amount of toner, it is required to pass the residual toner through the cleaning means multiple times, which results in the necessity to rotate the intermediate transfer member multiple times.

Consequently, when a toner image is not appropriately transferred to a recording material and remains on an intermediate transfer member, a long time is required to remove the toner from the intermediate transfer member, which leads to a problem in that the period of time for which image formation cannot be performed by an image forming apparatus increases.

SUMMARY OF THE INVENTION

It is therefore an object of the present invention to provide an image forming apparatus which includes an intermediate transfer member and with which when a developer image on the intermediate transfer member is not appropriately transferred to a recording material, it is possible to perform cleaning of the developer on the intermediate transfer member in a short time to thereby shorten a period of time for which image formation cannot be performed.

Further, another object of the present invention is to provide an image forming apparatus including: a plurality of image bearing members; electrostatic image forming means for forming an electrostatic image on each of the image bearing members; developing means for developing as a developer image the electrostatic image formed on each of the image bearing members by using developer charged to a predetermined polarity; primary transferring means for primarily transferring the developer image borne by each of the image bearing members to an intermediate transfer member at an associated one of a plurality of primary transfer portions; secondary transferring means for secondarily transferring the developer image primarily transferred to the intermediate transfer member to a recording material at a secondary transfer portion; cleaning means for cleaning the developer on the intermediate transfer member; and controlling means for, when a secondary untransferred developer image, which has not been secondarily transferred after the primary transfer, is cleaned from the intermediate transfer member, variably controlling a cleaning condition of the cleaning means in accordance with one of an image ratio and a position of the secondary untransferred developer image.

DESCRIPTION OF THE PREFERRED EMBODIMENTS

According to the present invention, the problems described above are solved by providing "controlling means for, when a secondary untransferred developer image that has not been secondarily transferred after being primarily transferred is cleaned from an intermediate transfer member, variably controlling a cleaning condition of cleaning means in accordance with the image ratio or position of the secondary untransferred developer image".

That is, a cleaning condition under which it is possible to shorten a cleaning time varies depending on the image ratio or position of the secondary untransferred developer image. Therefore, by variably controlling the cleaning condition in accordance with the image ratio or position of the secondary untransferred developer image, it becomes possible to shorten the cleaning time.

Hereinafter, the image forming apparatus according to the present invention will be described in more detail with reference to the accompanying drawings.

First Embodiment

Figure 1:
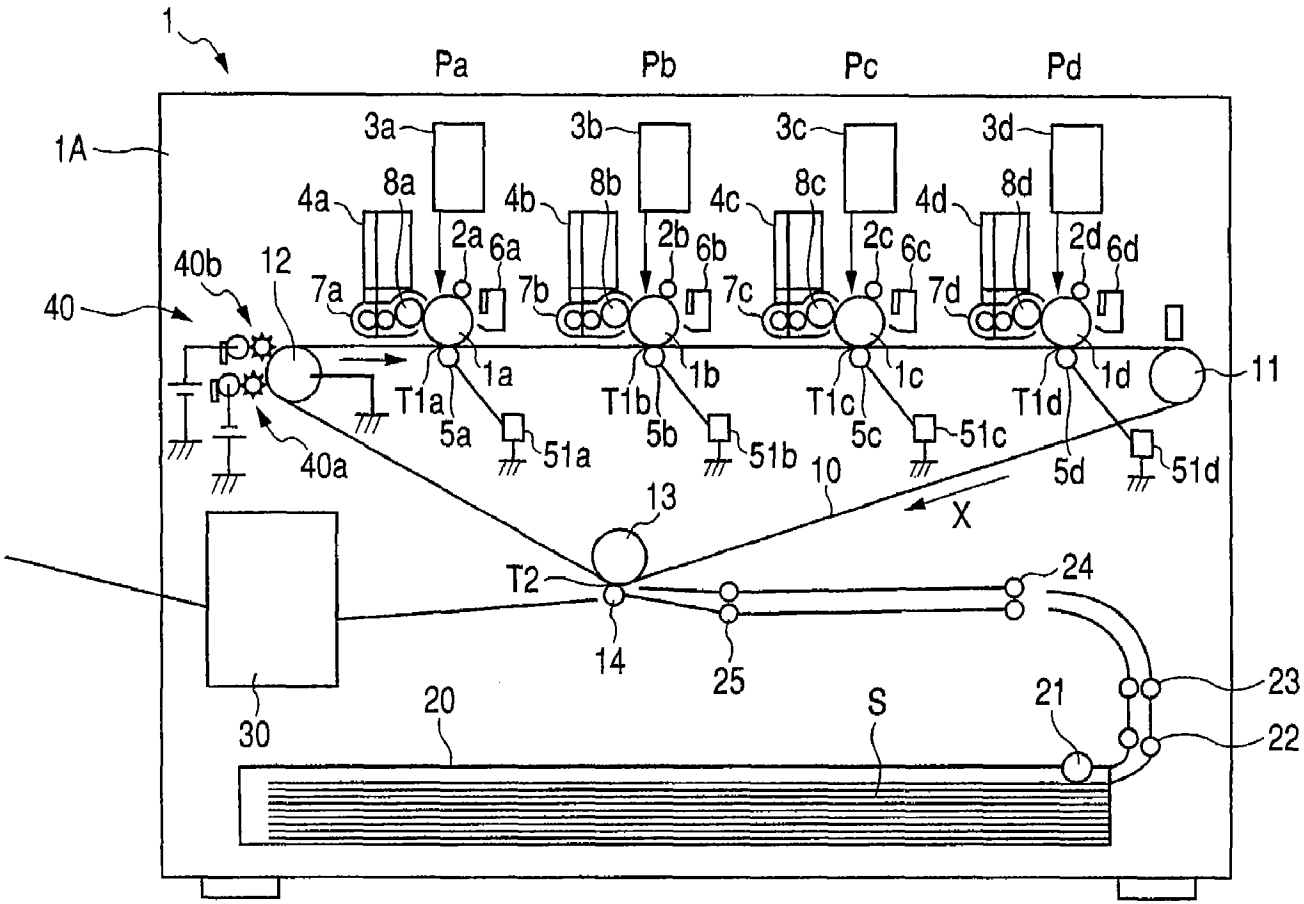
FIG. 1 is a cross-sectional view showing a construction of an embodiment of an image forming apparatus according to the present invention.

FIG. 1 shows a schematic construction of a multi-color image forming apparatus adopting a tandem method that is an embodiment of an image forming apparatus according to the present invention.

In this embodiment, an elastic intermediate transfer belt 10 that is an endless (belt-shaped) elastic intermediate transfer member having a peripheral length L and moved at a speed of v mm/second in a direction indicated by the arrow X is disposed in an apparatus main body 1A of an image forming apparatus 1. The elastic intermediate transfer belt 10 is wound around a drive roller 11, a tension roller 12, and a backup roller 13 as a support member. Along a horizontal portion of the elastic intermediate transfer belt 10, four image forming portions P (Pa, Pb, Pc, and Pd) are arranged in series. The image forming portions P (Pa, Pb, Pc, and Pd) have substantially the same construction but differ from each other in that they respectively form toner images in yellow (Y), magenta (M), cyan (C), and black (K).

First, the image forming portion Pa will be described. The image forming portion Pa includes a drum-shaped electrophotographic photosensitive member (hereinafter referred to as the "photosensitive drum") 1*a* that is a rotatable image bearing member. Around the photosensitive drum 1*a*, various process devices are arranged which are a primary charger 2*a* that is primary charging means, an exposing apparatus 3*a* that is exposing means, a developing device 4*a* that is developing means, a transfer apparatus 5*a* that is primary transferring means, a cleaning apparatus 6*a* that is cleaning means, and the like.

Other image forming portions Pb, Pc, and Pd have the same construction as the image forming portion Pa, and respectively include photosensitive drums 1*b*, 1*c*, and 1*d*, primary chargers 2*b*, 2*c*, and 2*d*, exposing apparatuses 3*b*, 3*c*, and 3*d*, developing devices 4*b*, 4*c*, and 4*d*, transfer rollers 5*b*, 5*c*, and 5*d*, and cleaning apparatuses 6*b*, 6*c*, and 6*d*.

The image forming portions Pa, Pb, Pc, and Pd differ from each other in that they respectively form toner images in yellow, magenta, cyan, and black. Also, in the developing devices 4*a*, 4*b*, 4*c*, and 4*d* arranged at the respective image forming portions Pa, Pb, Pc, and Pd, yellow toner (yellow developer), magenta toner (magenta developer), cyan toner (cyan developer), and black toner (black developer) are respectively contained.

Next, an image forming operation of the image forming apparatus having the construction described above will be explained.

The photosensitive drum 1*a* is uniformly charged by the primary charger 2*a* and an image signal by a yellow component color of an original is projected from the exposing apparatus (electrostatic image forming means) 3*a* onto the photosensitive drum 1*a* through a polygon mirror and the like, thereby forming an electrostatic latent image. Next, the yellow toner is supplied from the developing device 4*a* and the electrostatic latent image is developed as a yellow toner image.

Following rotation of the photosensitive drum 1*a*, the yellow toner image reaches a primary transfer portion T1*a*, at which the photosensitive drum 1*a* and the elastic intermediate transfer belt 10 are abutted against each other. In this embodiment, at the primary transfer portion T1*a*, the transfer roller 5*a* is arranged as primary transferring means and a primary transfer bias is applied to the transfer roller 5*a*. Consequently, the yellow toner image on the photosensitive drum 1*a* is primarily transferred to the intermediate transfer belt 10.

When the yellow toner image on the elastic intermediate transfer belt 10 is transported to the next image forming portion Pb, a magenta toner image formed by that time at the image forming portion Pb with the same method as above on the photosensitive drum 1*b* is transferred onto the yellow toner image at a primary transfer portion T1*b* where the transfer roller 5*b* is arranged. In a like manner, as the elastic intermediate transfer belt 10 advances to the image forming portions Pc and Pd along the direction indicated by the arrow, a cyan toner image and a black toner image are superimposedly transferred onto the toner images described above at primary transfer portions T1*c* and T1*d* where the transfer rollers 5*c* and 5*d* are respectively arranged.

By that time, a recording material S sent out from a sheet feeding cassette 20 by a sheet feeding roller 21 and other transport rollers 22 to 25 reaches a secondary transfer portion T2. At the secondary transfer portion T2, a secondary transfer apparatus (secondary transfer roller 14, in this embodiment) that is secondary transferring means is arranged so as to oppose the backup roller 13 and nip the elastic intermediate transfer belt 10 therebetween, and a transfer bias is applied to the transfer roller 14. As a result, the toner images in the four colors described above are transferred (secondarily transferred) onto the recording material S.

The recording material S, to which the toner images have been transferred, is transported to a fixing portion 30. At the fixing portion 30, the toner images are fixed onto the recording material S by means of heat and pressure.

Transfer residual toner on the photosensitive drums 1 (1*a*, 1*b*, 1*c*, and 1*d*) that was not transferred at the primary transfer portions T1 (T1*a*, T1*b*, T1*c*, and T1*d*) is cleaned by the respective cleaning apparatuses 6 (6*a*, 6*b*, 6*c*, and 6*d*).

Also, transfer residual toner on the intermediate transfer belt 10 that was not transferred at the secondary transfer portion T2 is cleaned by an intermediate transfer member cleaning apparatus 40 and is used in the next image formation. In this embodiment, the intermediate transfer member cleaning apparatus 40 includes a first cleaning apparatus 40*a* and a second cleaning apparatus 40*b*.

Next, constructions of the respective portions will be described one by one.

The photosensitive drums 1 (1*a*, 1*b*, 1*c*, and 1*d*) that are image bearing members are each obtained by applying an organic photoconductive layer (OPC) to the outer peripheral surface of an aluminum-made cylinder whose diameter is 80 mm. The photosensitive drums 1 are each supported by flanges in its both end portions so that it is free to rotate, and rotationally driven in a counterclockwise direction in FIG. 1 through transmission of a drive force from a drive motor (not shown) to one of the both end portions.

The primary chargers 2 (2*a*, 2*b*, 2*c*, and 2*d*) are each a conductive roller formed in a roller shape. By abutting the rollers 2 against surfaces of the photosensitive drums 1 and applying a charging bias voltage using a power supply (not shown), the surfaces of the photosensitive drums 1 are uniformly charged to the negative polarity.

In this embodiment, the exposing apparatuses 3 (3*a*, 3*b*, 3*c*, and 3*d*) are each an LED array, to whose front end a polygon mirror (not shown) is fitted, and their turning on/off is controlled by a drive circuit (not shown) in accordance with an image signal.

The developing devices 4 (4*a*, 4*b*, 4*c*, and 4*d*) are respectively positioned adjacent to toner containing portions 7 (7*a*, 7*b*, 7*c*, and 7*d*), which contain negatively charged toner in the respective colors of yellow, magenta, cyan, and black, and the surfaces of the photosensitive drums 1, and are rotationally driven by a drive portion (not shown). In addition, developing rollers 8 (8*a*, 8*b*, 8*c*, and 8*d*) are also provided which each performs development by applying a developing bias voltage using a developing bias power supply (not shown).

In this embodiment, as described above, in the toner containing portions 7, toner in the respective colors of yellow, magenta, cyan, and black is contained in this order from an upstream side in a transport direction of the recording material S.

In this embodiment, the peripheral length (L) of the intermediate transfer belt 10 is set at 2400 mm and the speed v thereof is set at 300 mm per second.

Inside the intermediate transfer belt 10, transfer bias power supplies (power supplies) 51 (51*a*, 51*b*, 51*c*, and 51*d*) are connected to the transfer rollers 5 (5*a*, 5*b*, 5*c*, and 5*d*) arranged to oppose the respective photosensitive drums 1*a*, 1*b*, 1*c*, and 1*d* and abutted against the intermediate transfer belt 10 and apply voltages having the positive polarity to the transfer rollers. By electric fields generated through the voltage application, the toner images in the respective colors, which exist on the photosensitive drums 1 and have the negative polarity, are transferred to the intermediate transfer belt 10 contacting the photosensitive drums 1 one by one, thereby forming a color image.

Figure 2:
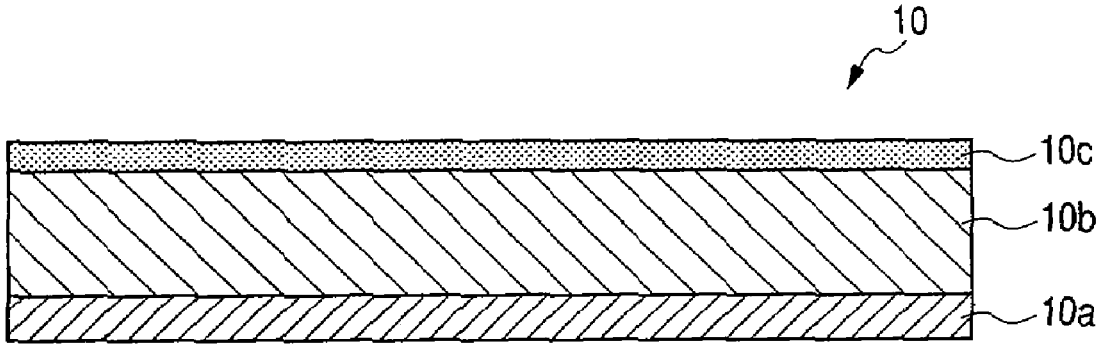
FIG. 2 is a cross-sectional view showing a construction of an intermediate transfer belt.

In this embodiment, an endless elastic intermediate transfer belt is used as the intermediate transfer belt 10. FIG. 2 shows a cross section of an embodiment of the elastic intermediate transfer belt 10.

In this embodiment, the elastic intermediate transfer belt 10 is an elastic belt having a three-layer structure including a resin layer 10*a*, an elastic layer 10*b*, and a surface layer 10*c*.

Used as resin materials which constitute the resin layer 10*a* may be one kind or two or more kinds selected from the group consisting of: polycarbonate; a fluorine-based resin (ETFR, PVDF); styrene-based resins (single polymers or copolymers composed of styrene or a styrene substitution) such as polystyrene, chloropolystyrene, poly-α-methyl styrene, styrene-butadiene copolymer, styrene-vinyl chloride copolymer, styrene-vinyl acetate copolymer, styrene-maleic acid copolymer, styrene-acrylate copolymers (such as styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylate copolymers (such as styrene-methyl methacrylate copolymer, styrene-ethyl methacrylate copolymer, and styrene-phenyl methacrylate copolymer), styrene-α-methyl chloracrylate copolymer, and styrene-acrylonitrile-acrylate copolymer; a methyl methacrylate resin; a butyl methacrylate resin; an ethyl acrylate resin; a butyl acrylate resin; a modified acrylic resin (such as a silicone-modified acrylic resin, a vinyl chloride resin-modified acrylic resin, or an acrylic/urethane resin); a vinyl chloride resin; styrene-vinyl acetate copolymer; vinyl chloride-vinyl acetate copolymer; a rhodine-modified maleic acid resin; a phenol resin; an epoxy resin; a polyester resin; a polyester-polyurethane resin; polyethylene; polypropylene; polybutadiene; polyvinylidene chloride; an ionomer resin; a polyurethane resin; a silicone resin; a ketone resin; ethylene-ethyl acrylate copolymer; a xylene resin and a polyvinyl butyral resin; a polyamide resin; a polyimide resin; a modified polyphenylene oxide resin; and a modified polycarbonate resin. However, the resin materials which constitute the resin layer 10*a* are not limited to those described above.

Used as elastic materials (elastic rubber, elastomer) which constitute the elastic layer 10*b* may be one kind or two or more kinds selected from the group consisting of butyl rubber, fluorine-based rubber, acrylic rubber, EPDM, NBR, acrylonitrile-butadiene-styrene natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorohydrin-based rubber, silicone rubber, fluororubber, polysulfide rubber, polynorbornene rubber, hydrogenated nitrile rubber, thermoplastic elastomer (such as a polystyrene-based, polyolefin-based, polyvinyl chloride-based, polyurethane-based, polyamide-based, polyurea, polyester-based, or fluororesin-based resin). However, it stands to reason that the elastic materials which constitute the elastic layer 10*b* are not limited to those described above.

Materials of the surface layer 10*c* are not particularly limited but are required to decrease adhesion force of a toner to the surface of the intermediate transfer belt 10 to thereby improve secondary transferability. Examples of materials of the surface layer 10*c* include materials that can decrease surface energy and improve a lubricating property using: one kind of resin material such as polyurethane, polyester, or an epoxy resin; or two or more kinds of elastic materials (elastic rubber, elastomer) such as butyl rubber, fluoro-based rubber, acrylic rubber, EPDM, NBR, acrylonitrile-butadiene-styrene natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, and urethane rubber. Examples of such materials include powder of a fluororesin, a fluorine compound, carbon fluoride, titanium dioxide, silicon carbide, and the like. One kind or two or more kinds of powder having different particle diameters can be used by dispersing particles thereof.

The resin layer 10*a* or the elastic layer 10*b* is added with a conducting agent for adjusting resistance. Examples of the conducting agent for adjusting resistance include, but are not particularly limited to: carbon black; glaphite; metallic powder of aluminium, nickel, or the like; and conductive metallic oxide such as tin oxide, titanium oxide, antimony oxide, indium oxide, potassium titanate, antimony oxide-tin oxide complex oxide (ATO), or indium oxide-tin oxide complex oxide (ITO). The conductive metallic oxide may be that obtained by coating insulating fine particles made of barium sulfate, magnesium silicate, calcium carbonate, or the like. The conducting agent is not limited to those described above.

Examples of a method of producing the intermediate transfer belt 10 described above include centrifugal casting method with which the belt is formed by pouring a material into a rotating cylindrical mold, a spray coating method with which the surface layer is formed as a thin film, a dipping method with which a cylindrical mold is immersed in a solution of the material and then is taken out from the solution, a casting method with which the material is poured into a space between the inner and outer cores of a mold, and a method with which a compound is provided around a cylindrical mold and vulcanization polishing is performed. Here, the present invention is not limited to the methods and it is also possible to produce the belt by combining multiple production methods.

The color image transferred to the intermediate transfer belt 10 at the primary transfer portions T1 is further secondarily transferred to the recording material S at the secondary transfer portion T2 where the secondary transfer roller 14 that is secondary transferring means is abutted against the intermediate transfer belt 10. The secondary transfer roller 14 is connected to a not-shown transfer bias power supply and receives application of a voltage having a positive polarity from the power supply. By an electric field generated through the voltage application, the toner image existing on the intermediate transfer belt 10 and having the negative polarity is transferred to the recording material S contacting the intermediate transfer belt 10, thereby forming a color image.

Figure 3:
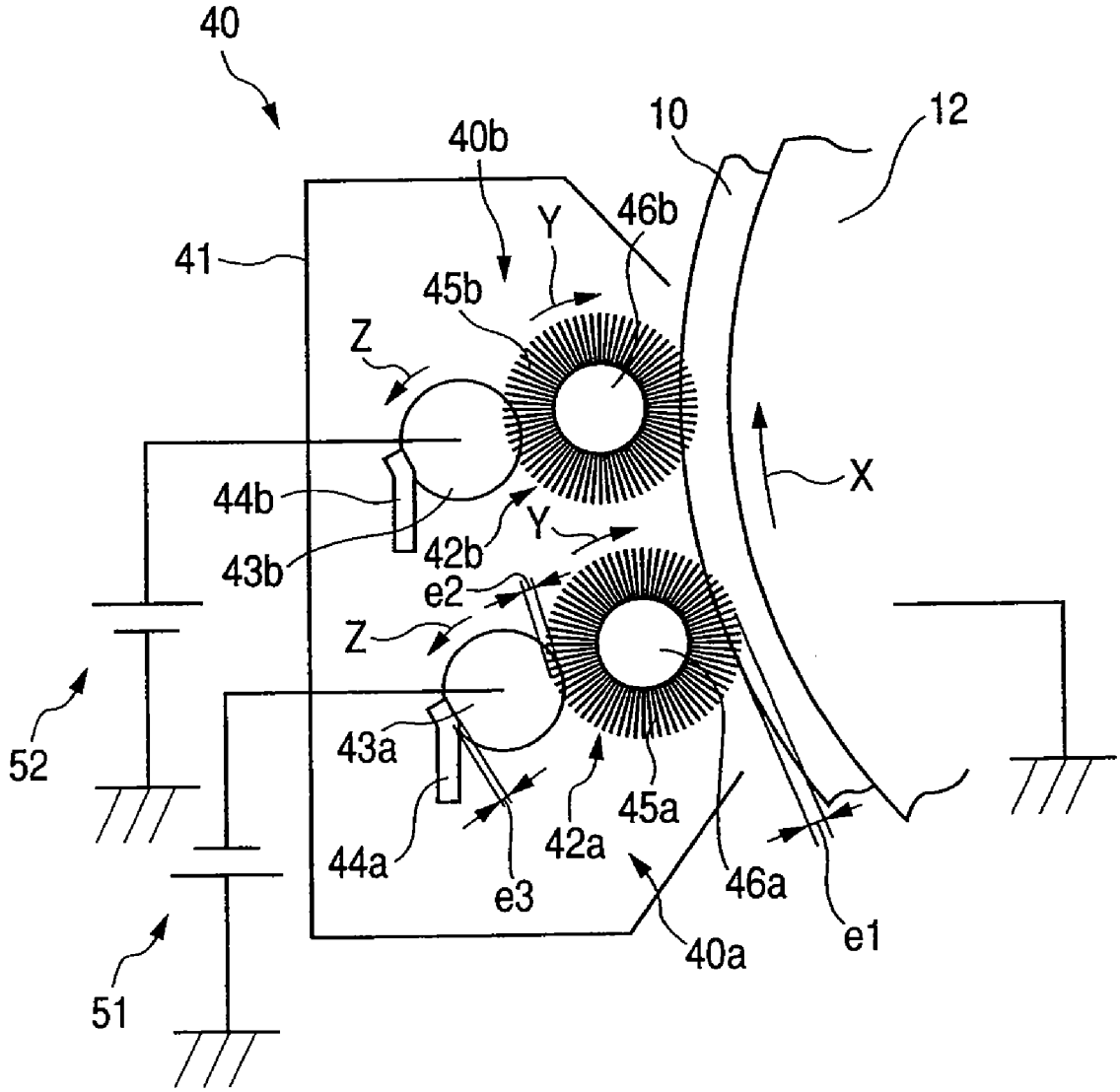
FIG. 3 is a cross-sectional view showing a construction of an intermediate transfer member cleaning apparatus.
Figure 4:
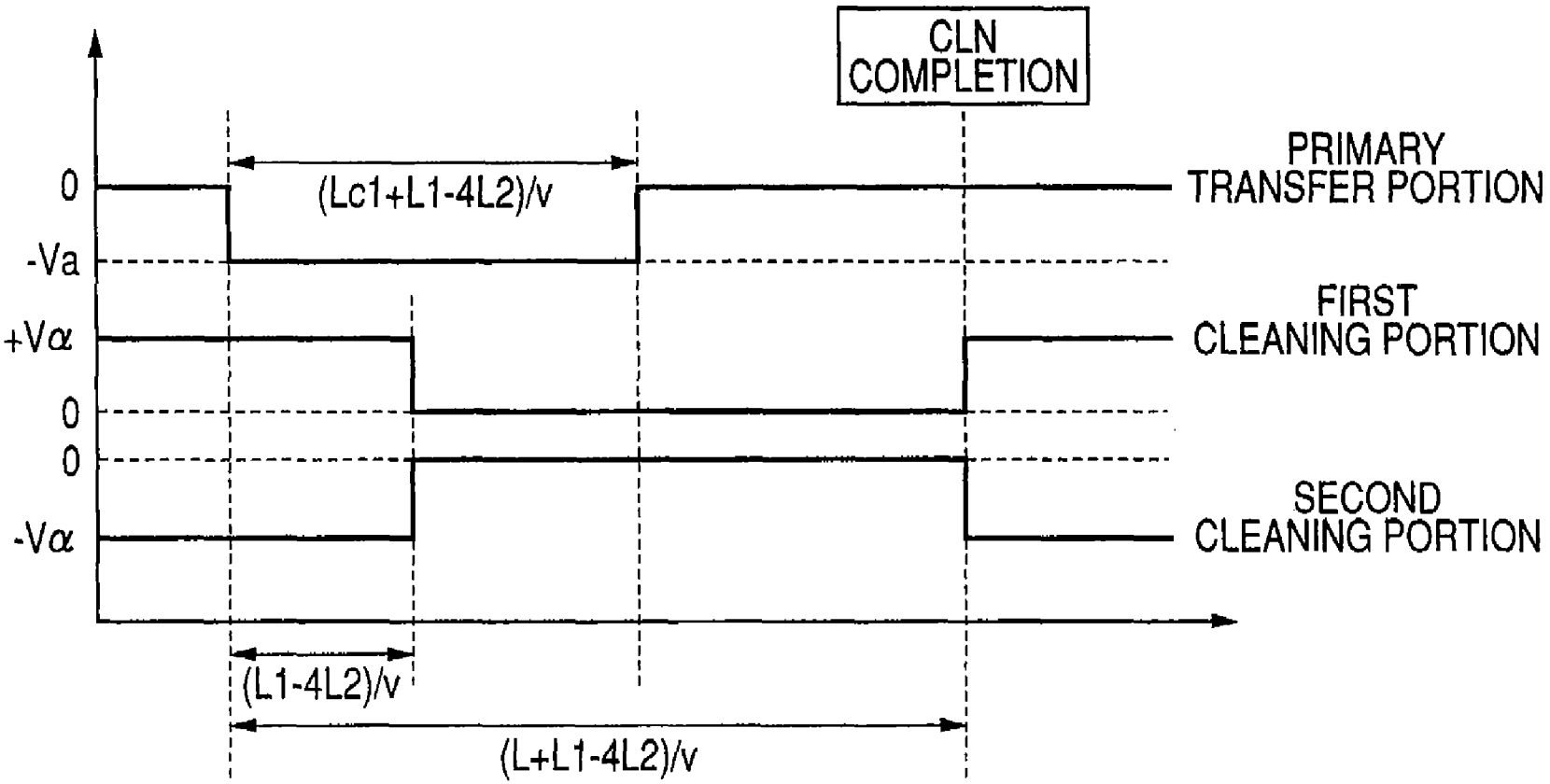
FIG. 4 is an explanatory diagram of a recovery sequence in the case where an image formation operation is stopped abnormally.
Figure 5:
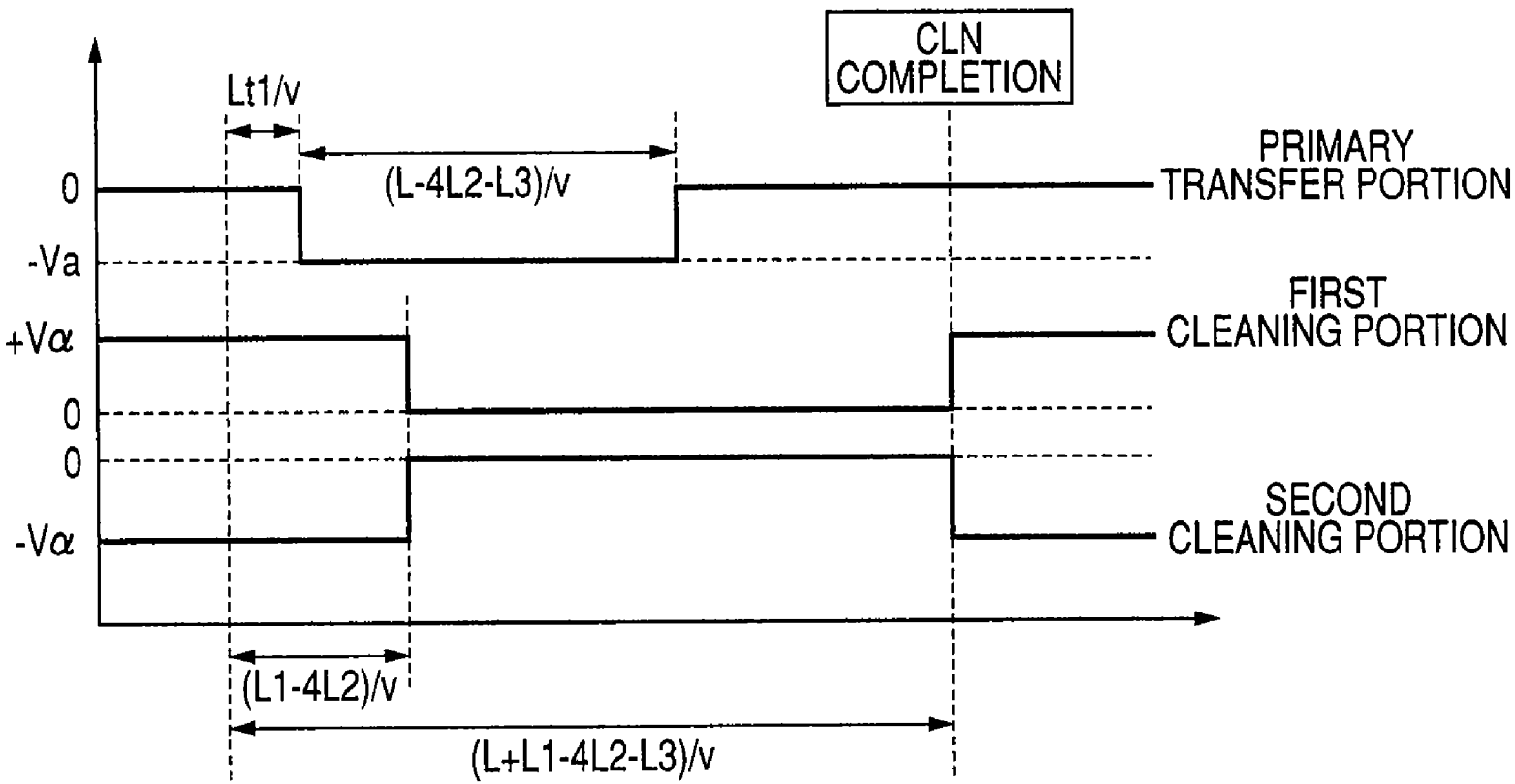
FIG. 5 is an explanatory diagram of a recovery sequence in the case where an image formation operation is stopped abnormally.
Figure 6:
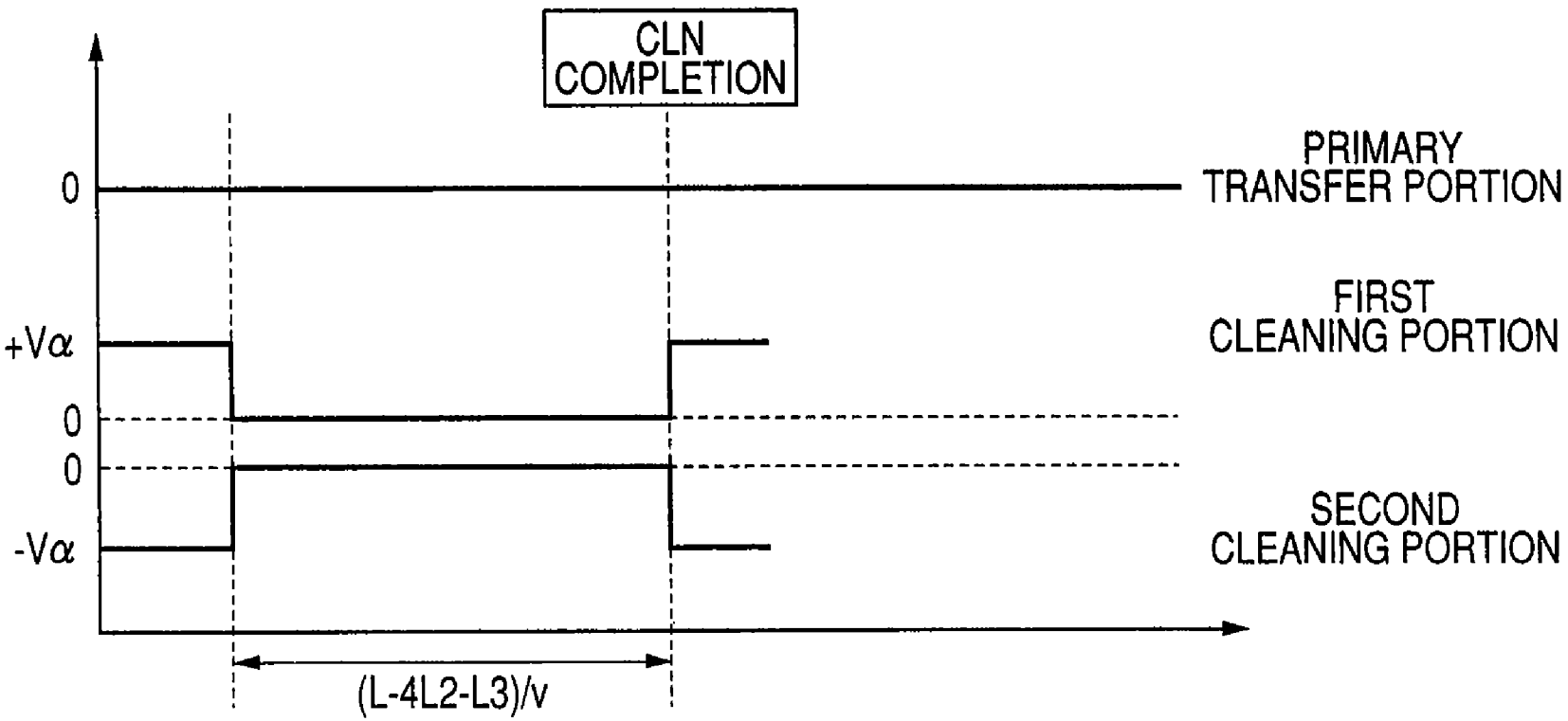
FIG. 6 is an explanatory diagram of a recovery sequence in the case where an image formation operation is stopped abnormally.
Figure 7:
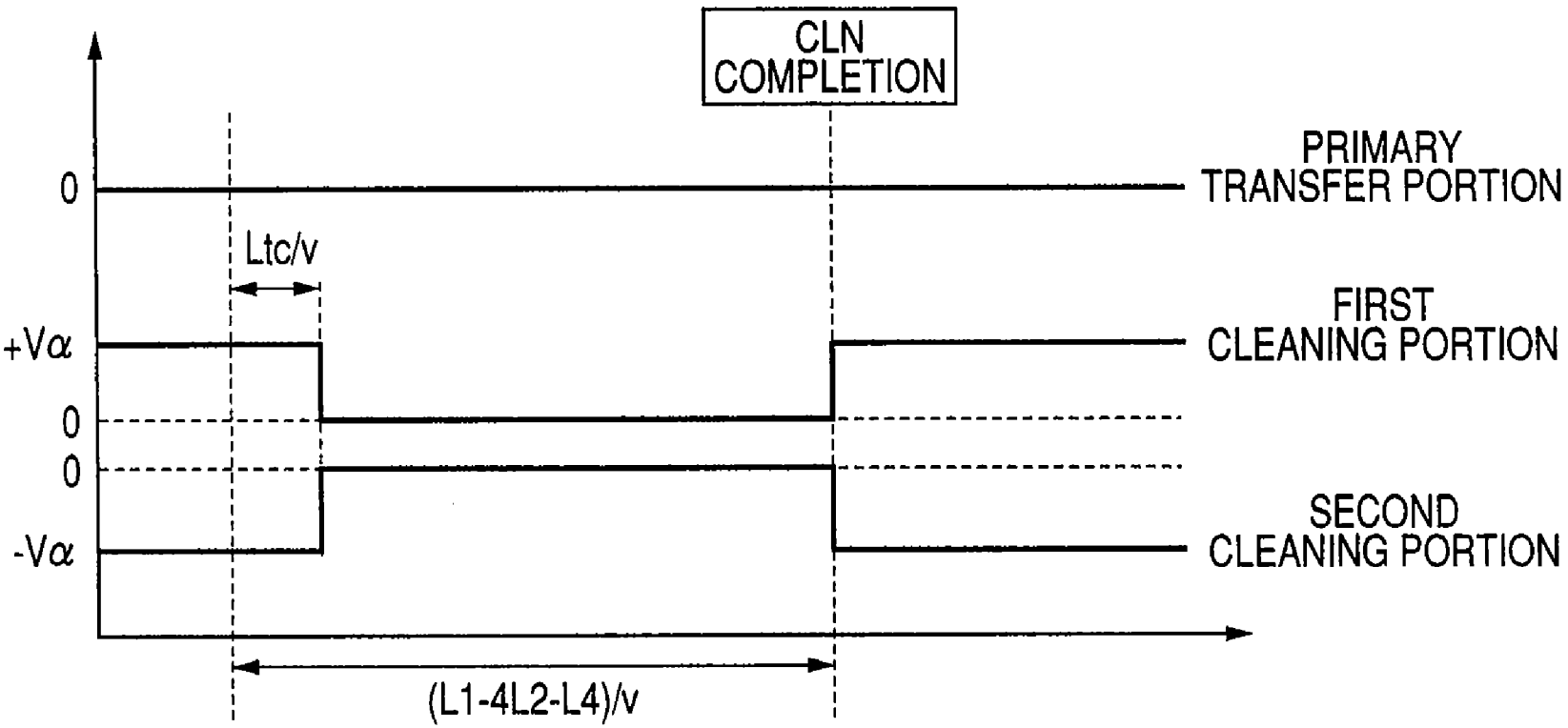
FIG. 7 is an explanatory diagram of a recovery sequence in the case where an image formation operation is stopped abnormally.
Figure 8:
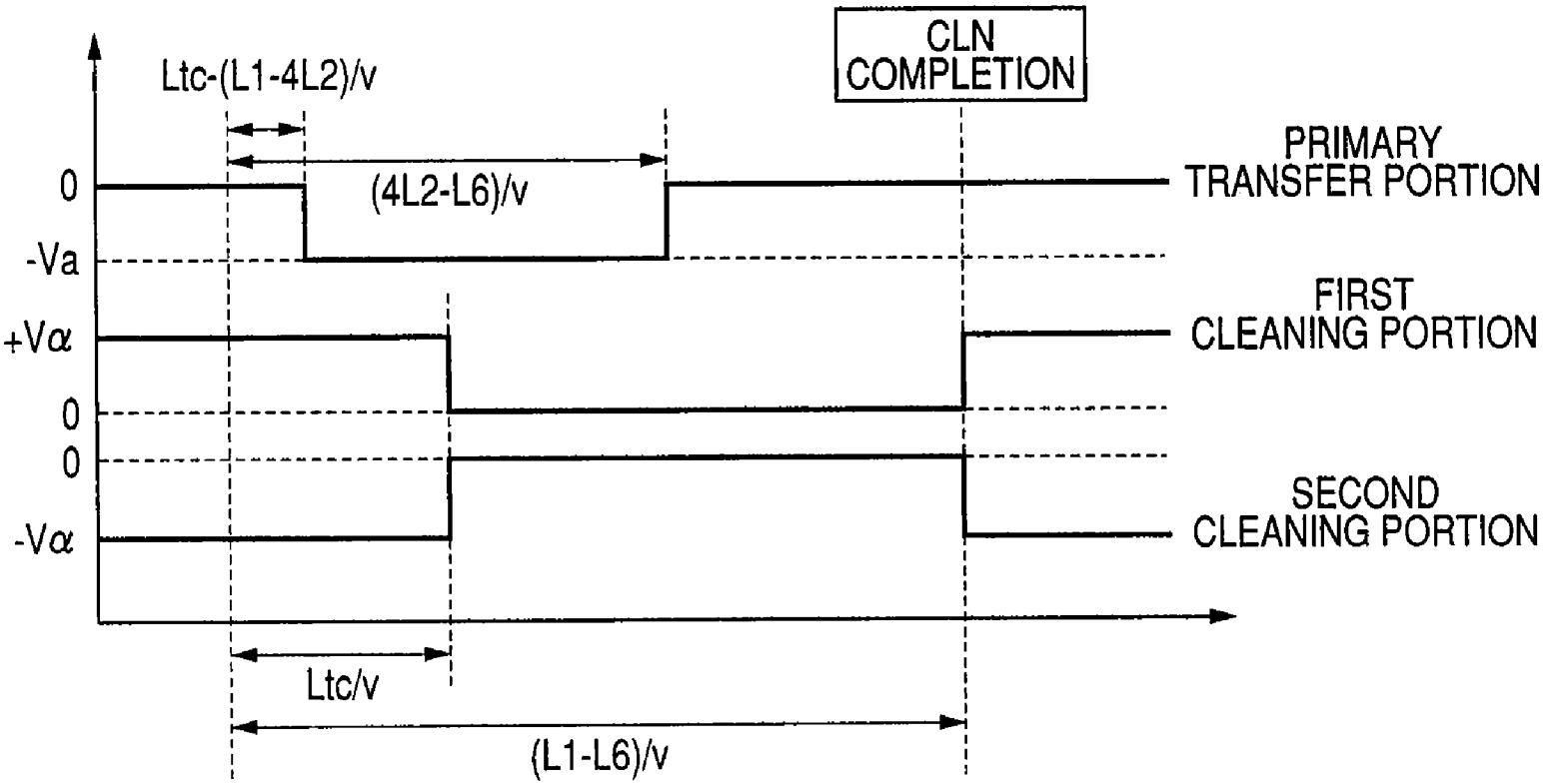
FIG. 8 is an explanatory diagram of a recovery sequence in the case where an image formation operation is stopped abnormally.
Figure 9:
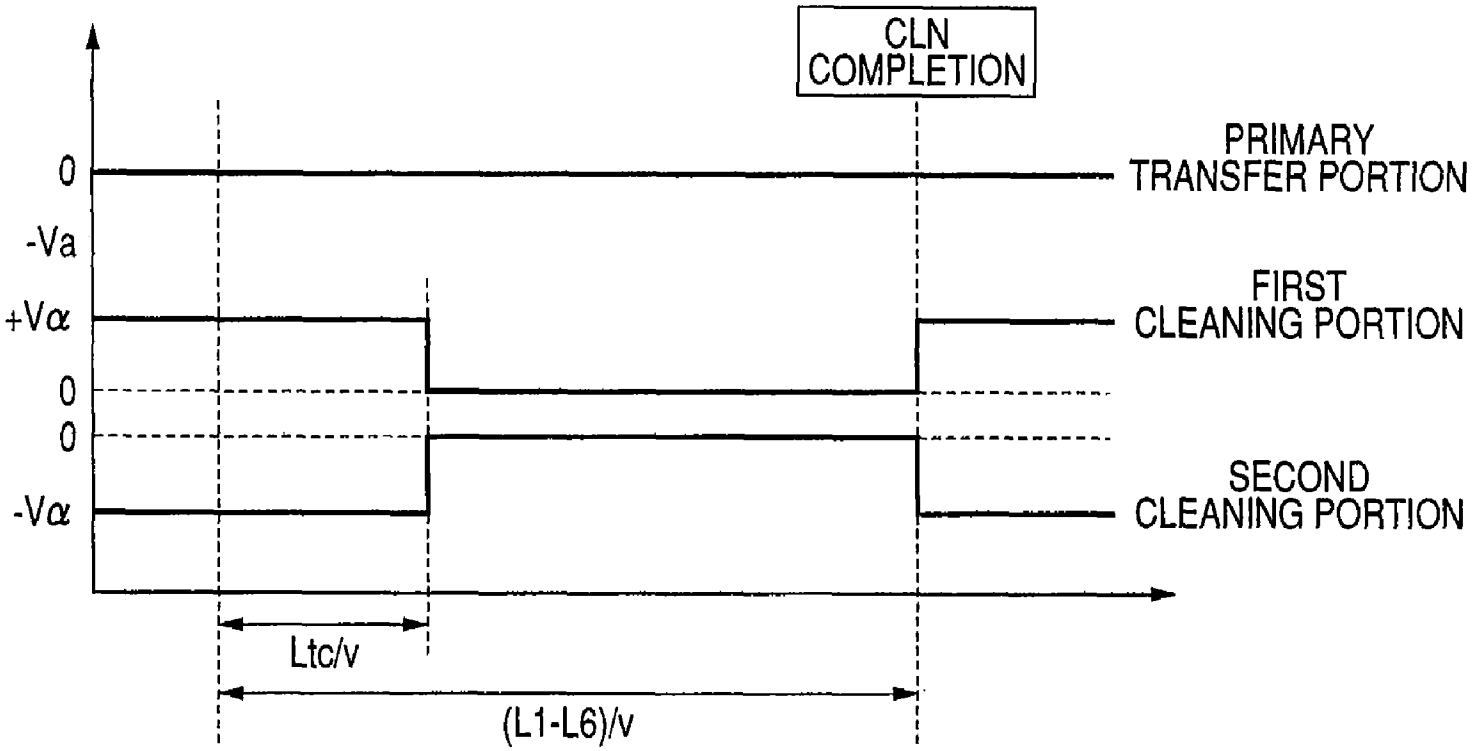
FIG. 9 is an explanatory diagram of a recovery sequence in the case where an image formation operation is stopped abnormally.

Next, an embodiment of the intermediate transfer member cleaning apparatus 40 for cleaning transfer residual toner remaining on the intermediate transfer belt 10 after secondary transfer will be described with reference to FIG. 3.

In this embodiment, an electrostatic brush cleaning apparatus is used as the intermediate transfer member cleaning apparatus 40. Also, the intermediate transfer member cleaning apparatus 40 includes a first cleaning apparatus 40*a* constituting a first cleaning portion and a second cleaning apparatus 40*b* constituting a second cleaning portion.

The first cleaning apparatus 40*a* and the second cleaning apparatus 40*b* have the same construction. That is, the first and second cleaning apparatuses (40*a*, 40*b*) are each arranged in an apparatus housing 41 arranged in proximity to the intermediate transfer belt 10. Also, the first and second cleaning apparatuses (40*a*, 40*b*) respectively include conductive fur brush rollers (cleaning members) 42 (42*a*, 42*b*). Further, the first and second cleaning apparatuses (40*a*, 40*b*) respectively include metallic rollers 43 (43*a*, 43*b*) that are respectively arranged to be abutted against the conductive fur brush rollers 42 (42*a*, 42*b*). Still further, the first and second cleaning apparatuses (40*a*, 40*b*) respectively include cleaning blades 44 (44*a*, 44*b*) that are respectively arranged to be abutted against the metallic rollers 43 (43*a*, 43*b*).

The conductive fur brush rollers 42 (42*a*, 42*b*) are each obtained by implanting carbon-dispersion-type nylon fibers 45 (45*a*, 45*b*), whose resistance value is 10 MΩ and fiber thickness is six deniers, into a conductive roller (metallic roller 46 (46*a*, 46*b*), in this embodiment) at an implantation density of 500,000/inch$^2$.

The metallic rollers 43 (43*a*, 43*b*) respectively arranged to be abutted against the conductive fur brush rollers 42 (42*a*, 42*b*) are each set as an aluminum-made metallic roller, whose surface has been subjected to hard alumite processing, and the cleaning blades 44 (44*a*, 44*b*) respectively arranged to be abutted against the metallic rollers 43 (43*a*, 43*b*) are each made of urethane rubber.

The conductive fur brushes 42 (42*a*, 42*b*) described above are each arranged to slidably contact the intermediate transfer belt 10 while maintaining an inroad amount (e1) of around 1.0 mm and rotated by a drive motor (not shown) at a speed of 50 mm/second in a direction indicated by the arrow Y. The metallic rollers 43 (43*a*, 43*b*) are each arranged while maintaining an inroad amount (e2) of around 1.0 mm with respect to the conductive fur brush 42 (42*a*, 42*b*) and are rotated at the same speed as the conductive fur brush 42 (42*a*, 42*b*) in a direction indicated by the arrow Z.

The cleaning blades 44 (44*a*, 44*b*) abutted against the metallic rollers 43 (43*a*, 43*b*) are set so that their inroad amounts (e3) with respect to the metallic rollers 43 become 1.0 mm.

A DC voltage of −500 V (grounding voltage, the same applies to the following description) is applied by a DC power supply (first cleaning power supply) 51 to the metallic roller 43*a* of the first cleaning apparatus 40*a* positioned on an upstream side with respect to a rotation direction (X direction) of the intermediate transfer belt 10. On the other hand, a DC voltage of +500 V is applied by a DC power supply (second cleaning power supply) 52 to the metallic roller 43*b* of the second cleaning apparatus 40*b* positioned on a downstream side with respect to the rotation direction (X direction) of the intermediate transfer belt 10.

As a result of the voltage application to the metallic roller 43*a*, a potential difference occurs between the intermediate transfer belt 10 and the conductive fur brush 42*a* and the (+) toner among the transfer residual toner on the intermediate transfer belt 10 is attracted and transferred to the conductive fur brush 42*a* side. The attracted and removed toner is further transferred from the conductive fur brush 42*a* to the metallic roller 43*a* by means of a potential difference and is scraped off by the cleaning blade 44*a*.

Even when the transfer residual toner on the intermediate transfer belt 10 has been cleaned by the first cleaning apparatus 40*a*, toner having no polarity and toner having the (−) polarity remain on the intermediate transfer belt 10. By the (−) bias applied to the fur brush 42*a*, the toner having no polarity is charged to (−) and the toner having the (−) polarity is further charged to (−). It is conceived that the toner is charged through charge injection or discharging.

Then, the toner having no polarity and the toner having the (−) polarity are removed by performing cleaning through application of a (+) bias to the second cleaning apparatus 40*b* arranged on the downstream side. The removed toner is transferred from the fur brush 42*b* to the metallic roller 43*b* by means of a potential difference and is scraped off by the cleaning blade 44*b*.

With the construction described above, it becomes possible to remove all of the transfer residual toner remaining on the intermediate transfer belt 10.

According to this embodiment, in the image forming apparatus having the construction described above, a cleaning condition for an untransferred image remaining on the intermediate transfer belt 10 is variably controlled in accordance with at least a signal value of a created image or positional information of the untransferred image at the time of start of cleaning of the intermediate transfer belt 10. That is, one of the following two cleaning sequences is selected.

(i) At the time of start of the cleaning sequence, a bias opposite to the transfer bias is applied to the untransferred image on the intermediate transfer belt 10 at the primary transfer portions T1 without activating the intermediate transfer member cleaning apparatuses 40. Then, after the untransferred image has been transferred to the photosensitive drums 1, the intermediate transfer member cleaning apparatus 40 is activated and cleaning is performed.

(ii) The untransferred image on the intermediate transfer belt 10 is cleaned only with the intermediate transfer member cleaning apparatus 40.

By preparing multiple case-specific cleaning sequences in this manner, the cleaning sequences are optimized and it becomes possible to shorten the time necessary for recovery from a jam and an emergency stop of the image forming apparatus.

Here, in this embodiment, the density of an image on a surface of the intermediate transfer belt 10 is detected at all times in an image forming operation (print job) and at the time of occurrence of an abnormal stop due to a jam or the like, it is judged based on the result of the detection whether an untransferred image on the intermediate transfer belt 10 should be removed with the intermediate transfer member cleaning apparatus 40 like in ordinary cases or cleaning should be performed by first transferring the untransferred image to the photosensitive drums 1 through application of the bias opposite to the transfer bias at the primary transfer portions T1 without activating the intermediate transfer member cleaning apparatus 40 and then activating the intermediate transfer member cleaning apparatus 40.

Next, an image forming operation control mechanism in this embodiment will be described with which the amount of developer on the intermediate transfer belt 10, that is, the image density of a transferred toner image is detected and occurrence of an abnormal termination of a print job is detected.

Figure 15:
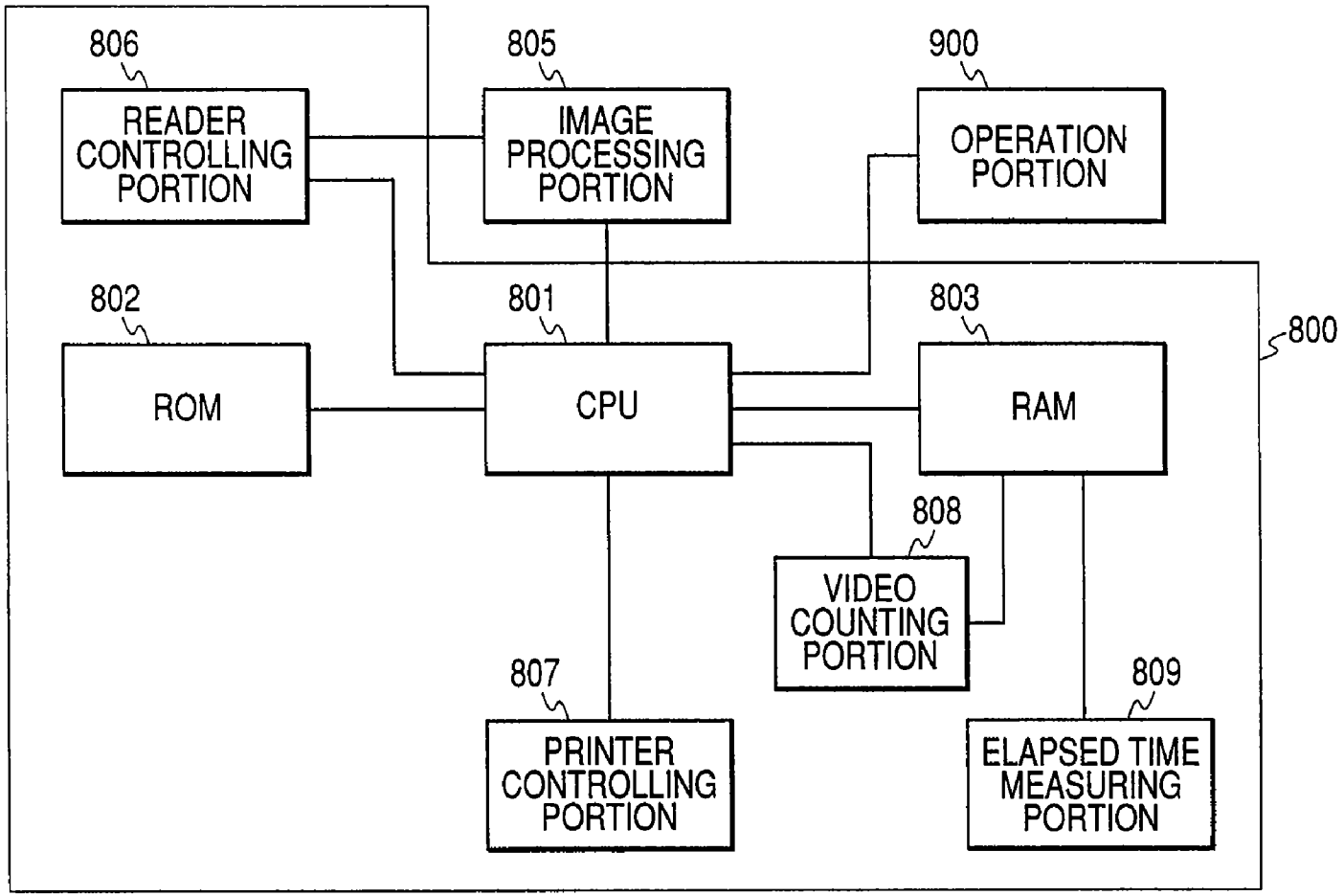
FIG. 15 is a block diagram showing an embodiment of an image formation controlling portion.

FIG. 15 is a control block diagram of a controlling portion 800 that is a controller portion and controls an image forming operation.

At the controlling portion 800, basic control is performed by a CPU 801. When broadly divided, six controlling mechanisms that are a ROM 802, a work RAM 803, a reader controlling portion 806, a printer controlling portion 807, an image processing portion 805, and an operation portion 900 are connected to the CPU 801.

Also, for data processing concerning an image forming condition, the ROM 802 storing a control program and the work RAM 803 for performing processing are connected to each other through an address bus and a data bus.

Further, for control of an image forming operation by each image forming means described above, the reader controlling portion 806 and the printer controlling portion 807 are respectively connected to an electric circuit including an input/output port and the like for controlling each construction element of the reader portion 200 and an electric circuit including an input/output port and the like for controlling each construction element of the printer portion 201.

The image processing portion 805 performs various kinds of image processing on digital data of an original image converted by the reader controlling portion 806 and a condition setting is made from the outside through the operation portion 900.

That is, based on the condition selected through the operation portion 900 and in accordance with the contents of the control program stored in the ROM 802, the control CPU 801 receives image processing by the image processing portion 805, controls the reader controlling portion 806 and the printer controlling portion 807, and carries out an image forming operation.

Here, an image forming operation is started by first setting a condition from the operation portion 900 and then transmitting a start signal.

Figure 16A:
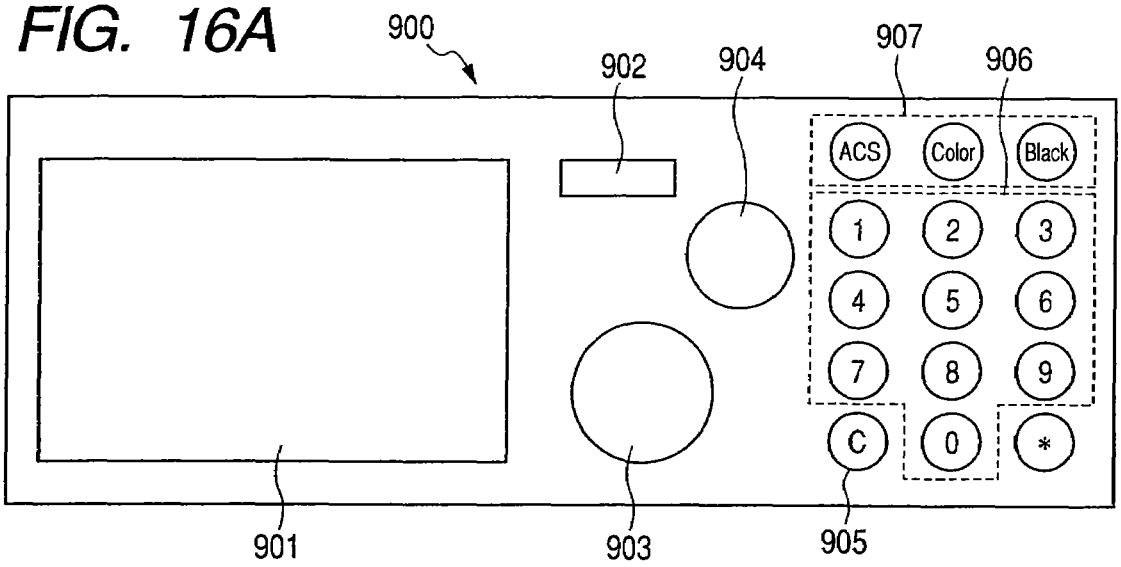
FIGS. 16A, 16B, and 16C are each an explanatory diagram showing an embodiment of an operation portion of the image forming apparatus.
Figure 16B:
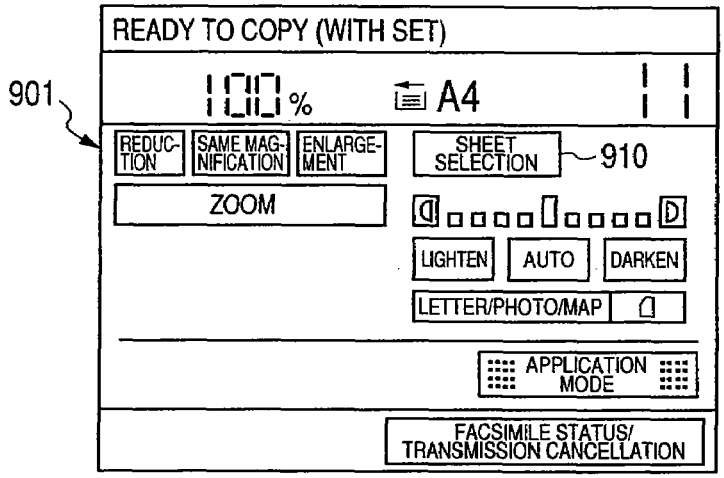
Figure 16C:
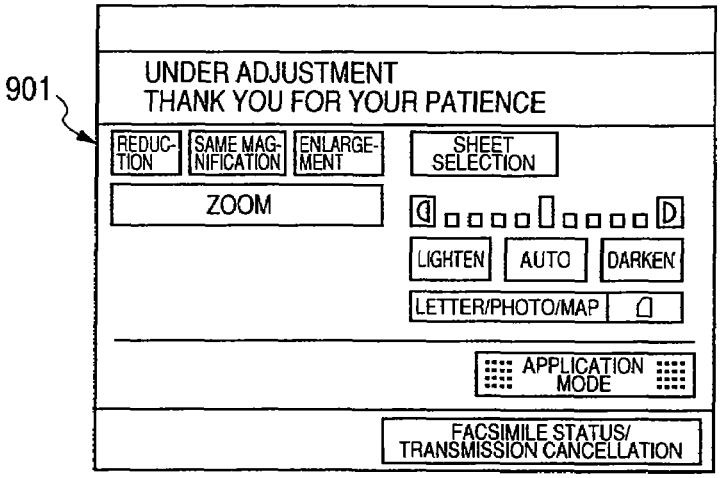

The operation portion 900 is shown in detail in FIG. 16A. The operation portion 900 includes a touch panel display 901 in which selected image forming conditions, such as the number of copies to be made, a selected sheet size, a magnification, and a copy density, are normally displayed as shown in FIG. 16B. In addition, the touch panel display 901 also has a function of displaying the state of the image forming apparatus for a user. More specifically, when it is possible to perform printing instantly, a message "READY TO COPY" is displayed in an upper portion of the touch panel display 901 as shown in FIG. 16B. Also, at the time of start-up of the apparatus, a message "UNDER ADJUSTMENT" is displayed as shown in FIG. 16C.

In addition, the image forming conditions, that is, a copy mode is designated with respective keys 902 to 907 provided for the operation portion 900. For instance, a copy mode is returned to a standard mode with a reset key 902. Also, a copy operation is started with a start key 903 and is stopped with a stop key 904. Further, it is possible to make a copy mode correction with a clear key 905. Still further, the number of copies to be made is set with a ten-key pad 906. Also, various color mode selection keys 907 are provided. The color mode selection keys 907 include an ACS key with which it is automatically discriminated whether an original is color or monochrome and color output is performed when the original has been discriminated as color and monochrome output is performed when the original has been discriminated as monochrome. In addition, the color mode selection keys 907 also include a Color key, with which color output is performed regardless of the type of the original, and a Black key with which monochrome output is performed regardless of the type of the original. One of the keys lights up.

Prior to an image forming operation (print job) by the image forming apparatus described above, a recording material P size is selected with a sheet selection key 910 shown in FIG. 16B of the touch panel display 901 of the operation portion 900 and the number of copies to be made is set with the ten-key pad 906 of the operation portion. Following this, the start key 903 is pressed, in response to which information about the settings is transmitted from the operation portion 900 to the CPU 801 in the controlling mechanism shown in FIG. 15, the information showing the sheet size, the number of copies to be made, and the like is stored in the RAM 803, and the print job is started.

During the print job, the density of the toner image formed on the intermediate transfer belt 10, that is, the toner images transferred from the photosensitive drums 1 onto the intermediate transfer belt 10 is detected at all times.

Incidentally, data of the formed image is written into the RAM 803 that is storing means of the controlling portion. Then, the number of image signals of each toner image in one color of the formed image is counted by the video count value counting portion (counting means) 808. A video count value obtained as a result of the counting is written into the RAM 803. With this construction, it is made possible to know the advancement status of image formation when the print job is abnormally ended due to a jam or the like. When a jam or the like has occurred, the image forming apparatus is stopped by the print controlling portion 807 that is stop means. That is, it is made possible to know the number of an image and the timing in the primary transfer process or the secondary transfer process at which the image formation has been abnormally ended. With reference to an image ratio (amount of dots formed per unit area) obtained from the video count value, the image density of the toner image formed on the intermediate transfer belt 10 is detected. Also, the position of the toner image at the time of the abnormal end is detected by measuring a lapsed time from the image formation start to the abnormal end using the lapsed time measuring portion (lapsed time measuring means) 809.

The video count value will be described.

Figure 17:
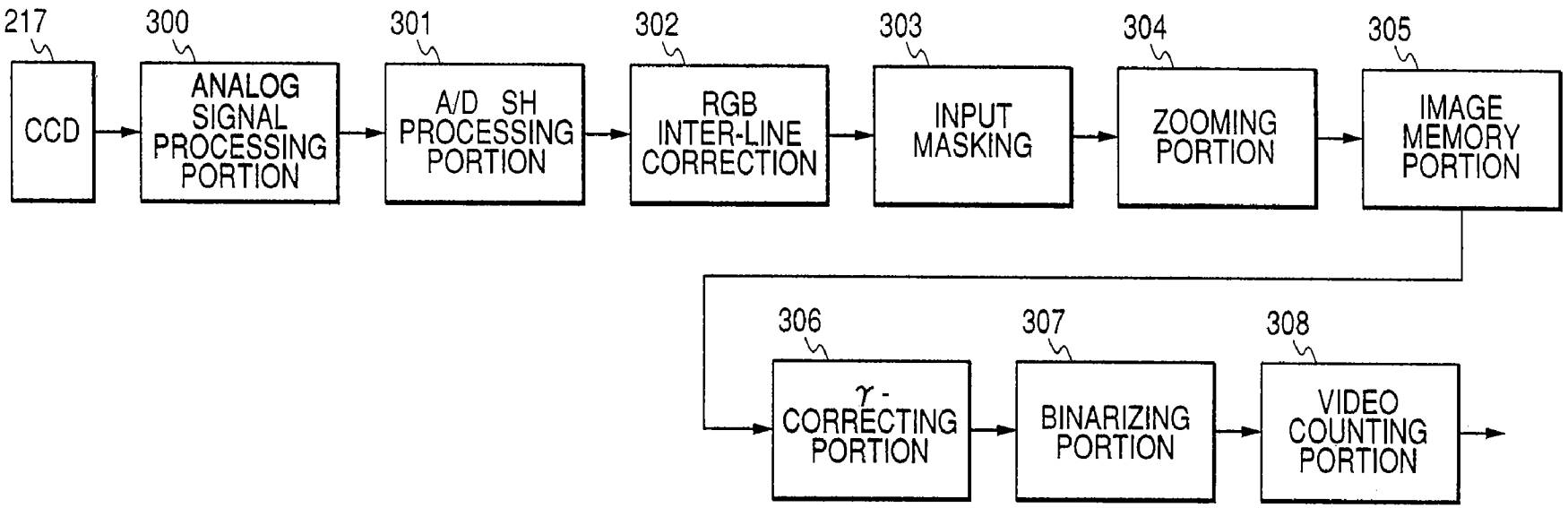
FIG. 17 is a block diagram showing an embodiment of an image processing portion of the image forming apparatus.

FIG. 17 is a block diagram showing an internal construction of the image processing portion 805 shown in FIG. 15 described above.

An original image imaged on a CCD sensor 217 is converted into an analog electric signal by the CCD sensor 217. The converted image information is inputted into an analog signal processing portion 300 in which sampling and holding, dark level correction, and the like are performed. Then, at the A/D·SH processing portion 301, analog/digital conversion (A/D conversion) is performed and then shading correction is performed on digitized signal. In the shading correction, correction of variations among pixels of the CCD sensor 217 and correction of variations in light quantity among positions based on the light distribution characteristic of an original illuminating lamp are performed.

Following this, RGB inter-line correction is performed at an RGB inter-line correction portion 302. Light inputted into each of RGB light receiving portions of the CCD sensor 217 at a certain point in time is displaced on the original in accordance with the positional relations among the respective RGB light receiving portions, so synchronization among RGB signals is established at the RGB inter-line correction portion 302.

Following this, at an input masking portion 303, input masking processing is performed and conversion from luminance data into density data is performed. RGB values outputted from the CCD sensor 217 are influenced by a color filter attached to the CCD sensor 217, so the influence is corrected and the RGB values are converted into pure RGB values.

Following this, the image is zooming-processed at a desired zooming ratio at a zooming portion 304 and image data after the zooming is sent to an image memory portion 305 and is accumulated therein.

The accumulated image data is sent from the image memory portion 305 to a γ-correcting portion 306. At the γ-correcting portion 306, in order to realize output corresponding to a density value set at the operation portion 900, conversion from original density data into density data corresponding to the desired output density is performed based on a lookup table (LUT) in which consideration is given to the characteristics of the printer. Next, the density data is sent to a binarizing portion 307. At the binarizing portion 307, an eight-bit multilevel signal is converted into a binary signal. The conversion is performed using, for instance, a dither method, an error diffusion method, a modified error diffusion method, or the like. The binarized data is sent to a video counting portion 308 in which counting of the binarized data is performed for each color image.

Figure 18:
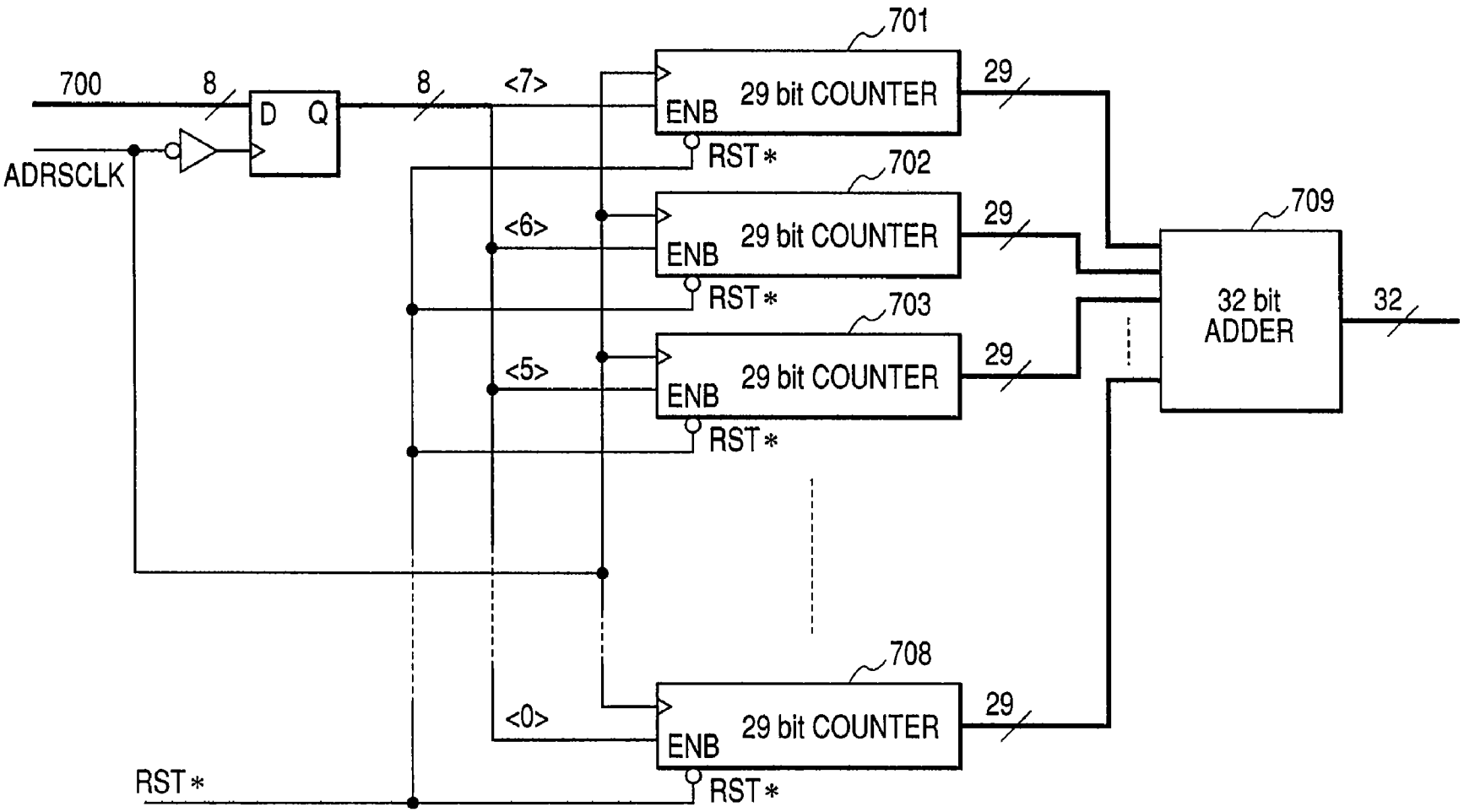
FIG. 18 is a block diagram showing an embodiment of a video counting portion.

FIG. 18 shows the details of the video signal counting portion 308. At the video signal counting portion 308, counting is performed for each color with the construction shown in FIG. 18. The image signal 700 of one image in one color sent from the binarizing portion 307 is counted by respective 29 bit counters 701 to 708 in units of eight bits in parallel.

Then, results of the counting are summed up by a 32 bit adder 709 and a video count for one image is obtained as 32 bit data.

That is, the video count value is a result of counting of the number of image signals of one image in processing of image signals read from the reader portion 200 at the image processing portion 805. Also, binarized data of density data obtained at the image processing portion 805 is derived from the video count value and the image density of a toner image formed on the intermediate transfer belt 10 is obtained.

In the image forming apparatus having the construction described above according to this embodiment, at the time of a jam occurring due to a paper jam, a mechanical failure, or the like or at the time of an emergency stop of the image forming apparatus due to opening of a door of the apparatus main body or the like, as many as eight untransferred images are formed at the maximum in the case of an A4 paper width. The details of a cleaning sequence for removing the untransferred toner (secondary untransferred toner) with efficiency are shown in FIGS. 4 to 9.

Figure 10:
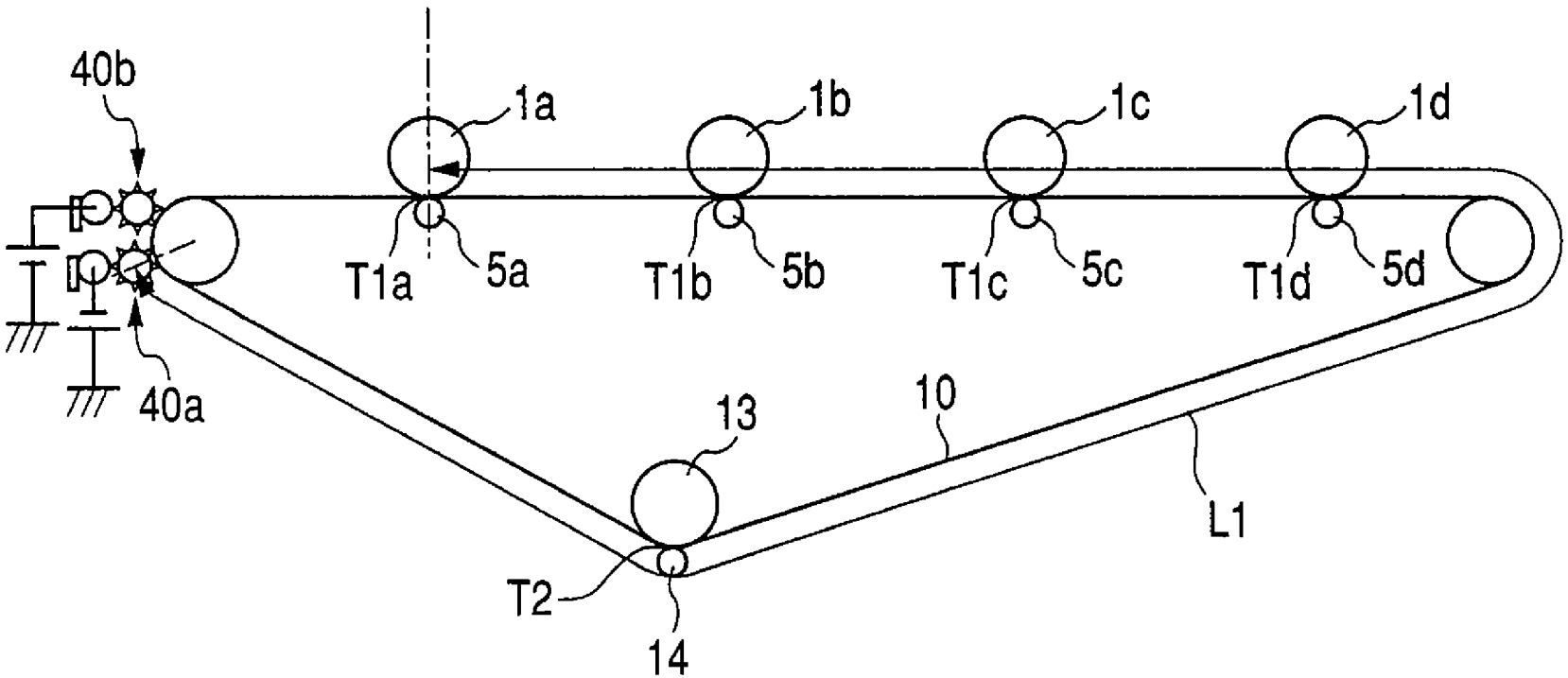
FIG. 10 is an explanatory diagram of a dimensional relation between the recovery sequence and the intermediate transfer belt.
Figure 11:
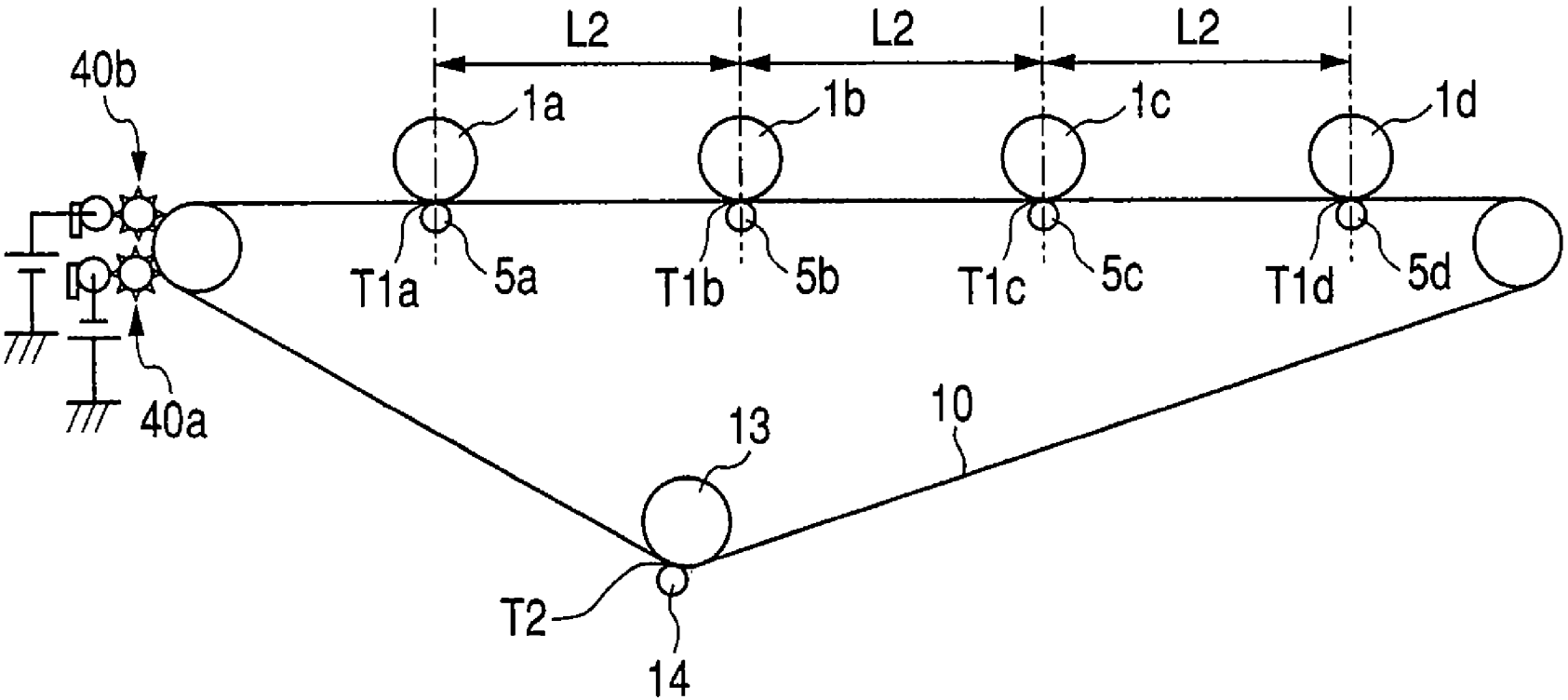
FIG. 11 is an explanatory diagram of a dimensional relation between the recovery sequence and the intermediate transfer belt.
Figure 12:
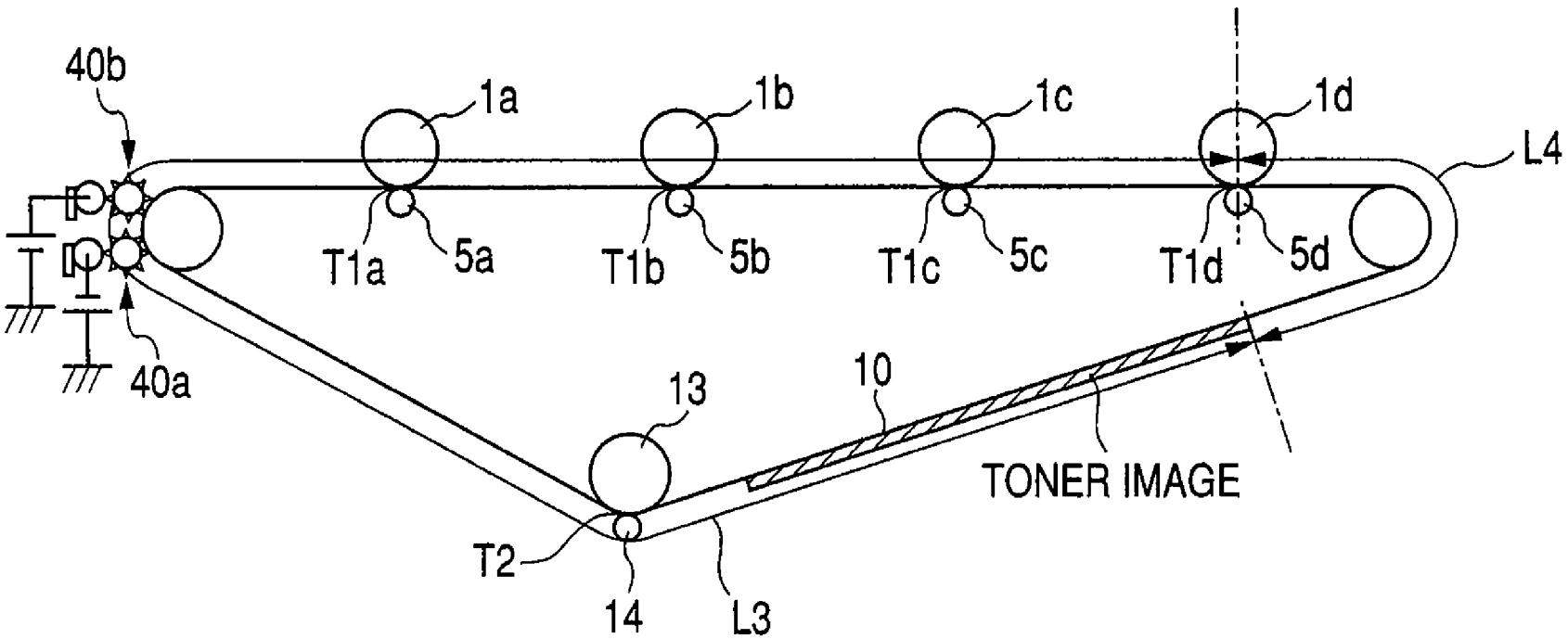
FIG. 12 is an explanatory diagram of a dimensional relation between the recovery sequence and the intermediate transfer belt.
Figure 13:
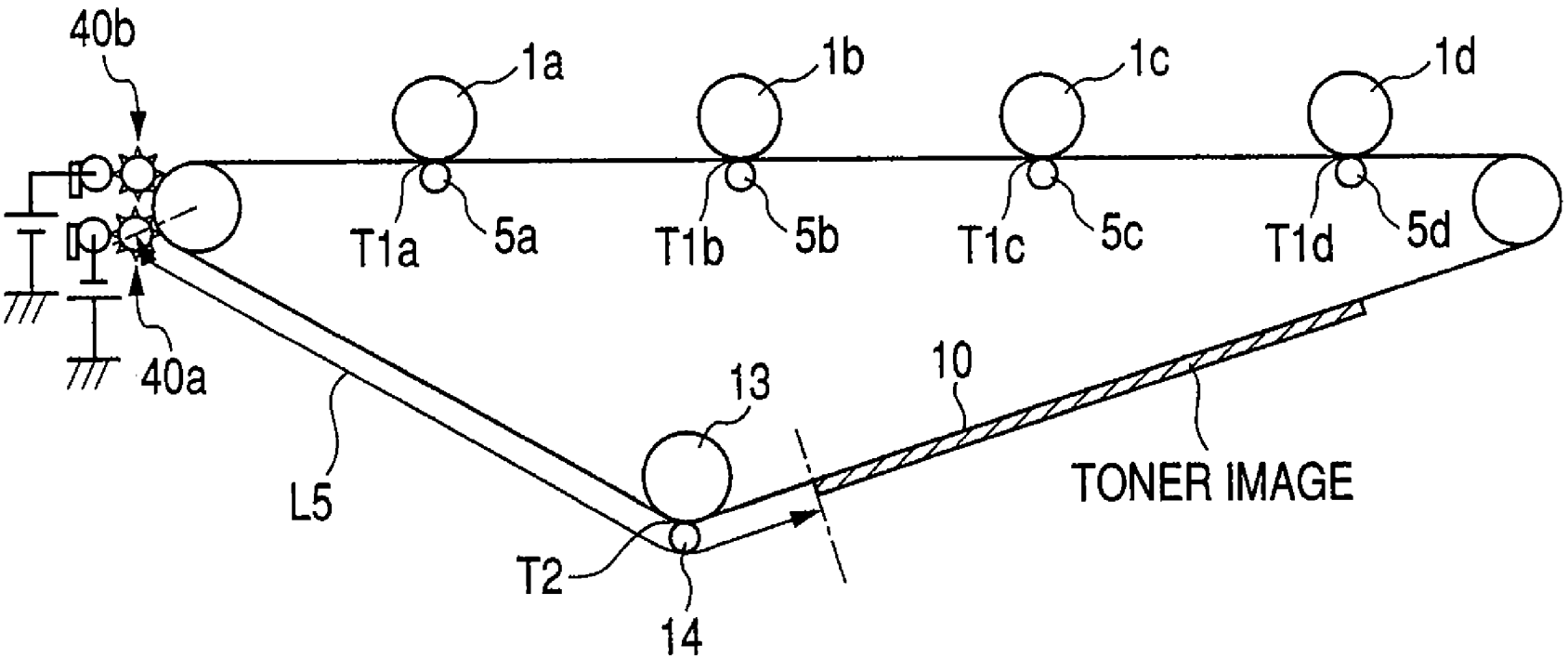
FIG. 13 is an explanatory diagram of a dimensional relation between the recovery sequence and the intermediate transfer belt.
Figure 14:
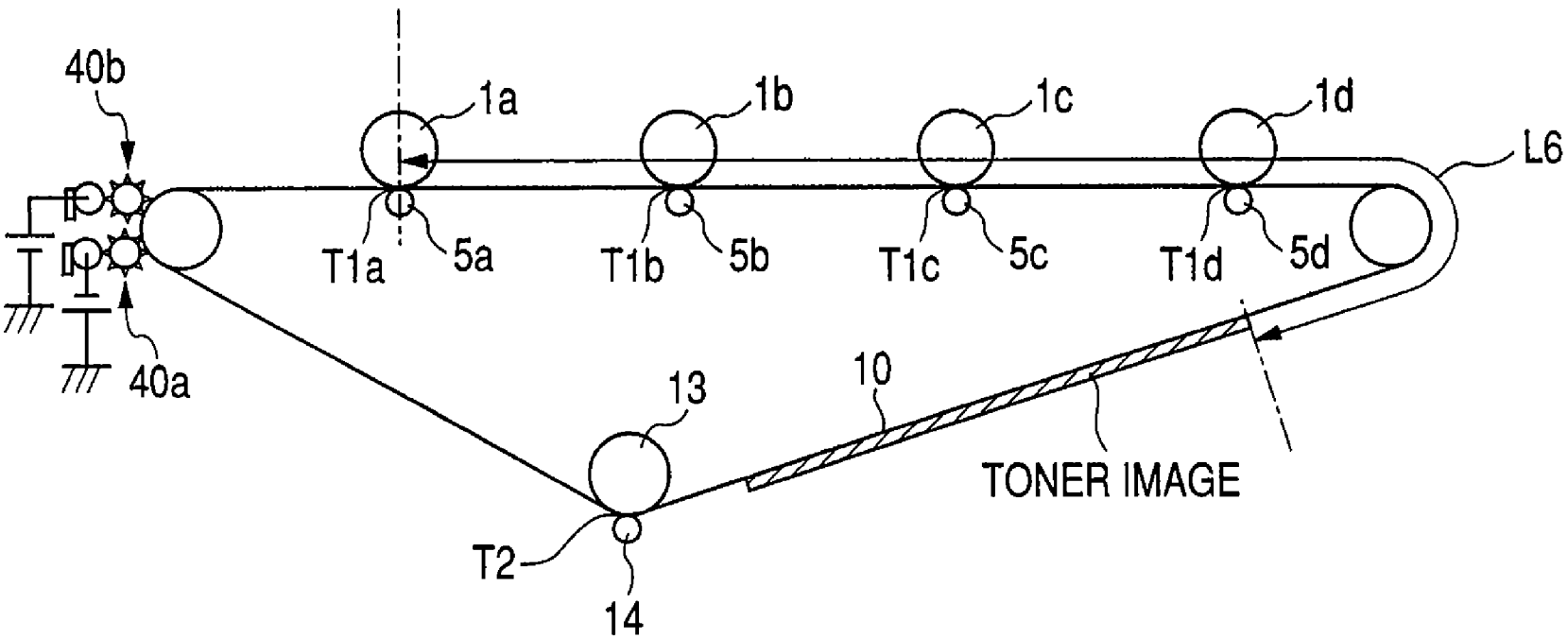
FIG. 14 is an explanatory diagram of a dimensional relation between the recovery sequence and the intermediate transfer belt.

Here, the peripheral length of the intermediate transfer belt 10 is assumed as "L" and a distance from the primary transfer portion T1*a* for yellow (Y) to the first cleaning apparatus 40*a* is assumed as "L1" (see FIG. 10). Also, distances between the primary transfer portions T1 of the respective stations are assumed as "L2" (see FIG. 11). Further, a distance from the primary transfer portion T1*d* for black (K) to the rear end of the untransferred toner on the upstream side is assumed as "L3" (see FIG. 12). Still further, a distance from the primary transfer portion T1*d* for black (K) to the read end of the untransferred toner on the downstream side is assumed as "L4" (see FIG. 12). Also, a distance from the front end portion of the untransferred toner to the cleaning member is assumed as "L5" (see FIG. 13) and a distance from the primary transfer portion T1*a* for yellow (Y) to the rear end of the untransferred toner is assumed as "L6" (see FIG. 14).

Based on the assumptions described above, examples will be described below.

First Example

When the rear end of the untransferred toner exists on an upstream side L3 of the primary transfer portion T1*d* of the black (K) station, a time necessary for the ordinary recovery sequence becomes as expressed by the following expression (FIG. 4):

$$T=(L+L1-4L2)/v.$$

When the toner image (untransferred toner image) that has been primarily transferred but is not secondarily transferred exists between the primary transfer portion T1*a* of the yellow (Y) station existing at the most upstream position in the rotation direction of the intermediate transfer belt 10 and the primary transfer portion T1*d* of the black (K) station existing at the most downstream position at the time of start of cleaning of the untransferred toner image like in this example, first, a bias whose polarity is the same as the charging polarity of the toner is applied to the primary transferring means. In this example, −600 V is applied.

Following this, the intermediate transfer belt 10 is rotated and the toner image existing between the primary transfer portion T1*a* of the yellow (Y) station and the primary transfer portion T1*d* of the black (K) station existing at the most downstream position is recovered by the photosensitive drums (1*a* to 1*d*).

Then, the cleaning sequence is variably controlled by the CPU 801 that is controlling means in accordance with the image density of the toner image existing between the primary transfer portion T1*d* of the black (K) station existing at the most downstream position and the secondary transfer portion T2. Here, the image density is obtained from an image ratio. That is, the cleaning sequence is variably controlled by the CPU 801 in accordance with the image ratio.

(1) A case where the image density of the untransferred toner image exceeds 0.3 mg/cm$^2$ A recovery sequence time becomes as expressed by the following expression like in the case of the ordinary sequence (FIG. 5):

$$T=(L+L1-4L2-L3)/v.$$

In this case, the untransferred toner image on the intermediate transfer belt 10 first passes through a position at which the cleaning by the intermediate transfer member cleaning apparatus 40 is performed, without being cleaned at the position following rotation of the intermediate transfer belt 10. Then, the untransferred toner image reaches the primary transfer portions T1 and is recovered by the photosensitive drums (1*a* to 1*d*). Following this, the untransferred toner image reaches the position at which the cleaning by the cleaning apparatus 40 is performed, again following the rotation of the intermediate transfer belt 10 and is cleaned by the cleaning apparatus 40 at the position.

(2) A case where the image density of the untransferred toner image is equal to or less than 0.3 mg/cm$^2$ The amount of the untransferred toner becomes one that can be recovered by the cleaning portion, so cleaning is performed by applying a bias at a timing at which the front end of the untransferred toner enters into the cleaning member. When the rear end of the untransferred toner has passed through the cleaning member, the recovery sequence is ended. A time necessary for the sequence in this case becomes as expressed by the following expression (FIG. 6):

$$T''=(L1-4L2-L3)/v.$$

In this case, when the untransferred toner image on the intermediate transfer member 10 has reached the position at which the cleaning by the intermediate transfer member cleaning apparatus 40 is performed, following the rotation of the intermediate transfer belt 10, it is recovered by the intermediate transfer member cleaning apparatus 40. Note that in this case, a situation will not occur in which the untransferred toner image passes through the position at which the cleaning by the intermediate transfer member cleaning apparatus 40 is performed, without being cleaned at the position.

Specific Example

In the case of L=2400 mm, L1=2000 mm, L2=50 mm, and L3=100 m, T, T', and T" described above respectively become 14 seconds, 13.7 seconds, and 5.6 seconds, which means that the recovery sequence is completed in a time that is around 41% of the time necessary for the conventional recovery sequence.

Second Example

When the rear end of the untransferred toner exists on a downstream side L4 of the black (K) station Pd and the front end portion of the untransferred toner exists between the black (K) station Pd and the secondary transfer portion T2, a time necessary for the ordinary recovery sequence becomes as expressed by the following expression (FIG. 4):

$$T2=(L+L1-4L2)/v.$$

In this case, at the time of start of cleaning of the untransferred toner image, no untransferred toner image exists between the primary transfer portion T1*a* of the yellow (Y) station existing at the most upstream position in the rotation direction of the intermediate transfer belt 10 and the primary transfer portion T1*d* of the black (K) station existing at the most downstream position. Accordingly, a situation will not occur in which at the time of the start of the cleaning of the untransferred toner, a bias having the same polarity as the toner is applied to the primary transferring means (5*a* to 5*d*) and the untransferred toner image is recovered by the photosensitive drums (1*a* to 1*d*).

The cleaning sequence is variably controlled in accordance with the image density of the toner image existing between the primary transfer portion T1*d* of the black (K) station existing at the most downstream position and the secondary transfer portion T2.

(1) A case where the image density of the untransferred toner image exceeds 0.3 mg/cm$^2$ A recovery sequence time becomes as expressed by the following expression like in the case of the ordinary sequence (FIG. 4):

$$T2'=(L+L1-4L2)/v.$$

(2) A case where the image density of the untransferred toner image is equal to or less than 0.3 mg/cm$^2$ The amount of the untransferred toner becomes one that can be recovered by the cleaning portion, so cleaning is performed by applying a bias at a timing at which the untransferred toner front end enters into the cleaning member. When the rear end of the untransferred toner has passed through the cleaning member, the recovery sequence is ended. A time necessary for the sequence in this case becomes as expressed by the following expression (FIG. 7):

$$T2''=(L1-4L2+L4)/v.$$

In this case, the intermediate transfer member cleaning apparatus 40 is activated and a situation will not occur in which the untransferred toner image on the intermediate transfer belt 10 is transferred to the photosensitive drums 1 at the primary transfer portions T1.

Specific Example

In the case of L=2400 mm, L1=2000 mm, L2=50 mm, and L4=75 mm, T2, T2', and T2" described above respectively become 14 seconds, 14 seconds, and 6.3 seconds, which means that the recovery sequence is completed in a time that is around 45% of a time necessary for the conventional recovery sequence.

Third Example

When transfer residual toner exists only between the primary transfer portions T1, when a distance between the yellow (Y) station Pa and the rear end of the untransferred toner is assumed as "L6", a time necessary for the ordinary recovery sequence becomes as expressed by the following expression (FIG. 4):

$$T3=(L+L1-4L2)/v.$$

Even in this third example, like in the first example, at the time of start of cleaning of the untransferred toner image, the untransferred toner image exists between the primary transfer portion T1*a* of the yellow (Y) station existing at the most upstream position in the rotation direction of the intermediate transfer belt 10 and the primary transfer portion T1*d* of the black (K) station existing at the most downstream position, so a bias whose polarity is the same as the charging polarity of the toner is first applied to the primary transferring means. Even in this third example, like in the first example, −600 V is applied.

Following this, the intermediate transfer belt 10 is rotated and the toner image existing between the primary transfer portion T1*a* of the yellow (Y) station and the primary transfer portion T1*d* of the black (K) station existing at the most downstream position is recovered by the photosensitive drums (1*a* to 1*d*).

In this case, the whole area of the untransferred toner image passes through the primary transfer portions T1 in which the bias having the same polarity as the toner is applied to the primary transferring means.

Therefore, the image density in the whole area of the untransferred toner image becomes lower than an image density obtained from a video counter value.

Accordingly, regardless of the image density of the untransferred toner image obtained from the video counter, the untransferred toner image is cleaned by the intermediate transfer member cleaning apparatus 40 after passing through the primary transfer portions T1. Even when the image density of the untransferred toner image obtained from the video counter value exceeds a predetermined value, a situation will not occur in which the untransferred toner image is not cleaned at the position at which cleaning by the intermediate transfer member cleaning apparatus 40 is performed, and passes through the position.

(1) A case where the image density of the untransferred toner image exceeds 0.3 mg/cm$^2$ A recovery sequence time becomes as expressed by the following expression (FIG. 8):

$$T3=(L1-L6)/v.$$

(2) A case where the image density of the untransferred toner image exceeds 0.3 mg/cm$^2$ A recovery sequence time becomes as expressed by the following expression (FIG. 9):

$$T3=(L1-L6)/v.$$

Specific Example

In the case of L=2400 mm, L1=2000 mm, L6=70 mm, T3, T3', and T3" described above respectively become 14 seconds, 6.4 seconds, and 6.4 seconds, which means that the recovery sequence is completed in a time that is around 9% of a time necessary for the conventional recovery sequence.

Fourth Example

When the image forming apparatus is abnormally stopped before a toner image is formed on the elastic intermediate transfer belt 10, a time necessary for the ordinary recovery sequence becomes as expressed by the following expression (FIG. 4):

$$T4=(L+L1-4L2)/v.$$

(1) A case where toner images are formed on the photosensitive drums 1

A time necessary for the recovery sequence is a time until the toner on the photosensitive drums 1 passes through the photosensitive drum cleaning portions.

When distances from the primary transfer portions T1 to the rear ends of the toner images are assumed as "L4" (which are shorter than distances from the developing portions to the primary transfer portions) and distances from the primary transfer portions T1 to the photosensitive drum cleaning portions are assumed as "Ldc", the recovery sequence time becomes as expressed by the following expression:

$$T4'=(L4+Ldc)/v.$$

(2) A case where toner images are not formed on the photosensitive drums 1

A time necessary for the recovery sequence becomes as expressed by the following expression:

$$T4''=0 \text{ second}.$$

Specific Example

In the case of L=2400 mm, L1=2000 mm, L2=50 mm, L4=10 mm, Ldc=60 mm, T4, T4', T4" described above respectively becomes 14 seconds, 0.23 seconds, and 0 seconds, which means that the recovery sequence is completed in a time that is around 1.5% of a time necessary for the conventional recovery sequence.

By optimizing the recovery sequence with reference to the video counter value and the image positional information in the manner described above, it becomes possible to significantly shorten a time necessary for recovery.

As described above, the image forming apparatus according to the present invention includes storage means for storing the digital signal of an image created by exposing means or a positional information storage apparatus that stores the positional information of the created image and a cleaning sequence after an abnormal stop of the image forming apparatus is determined in accordance with the image digital signal value stored in the storage means or the positional information.

That is, with the image forming apparatus according to the present invention, at the time of recovery from a jam or an abnormal stop of the image forming apparatus due to opening of a front cover or the like, a condition for cleaning an untransferred image remaining on the intermediate transfer member is determined in accordance with at least the signal value of a created image or the positional information of the image.

More specifically, a selection is made from among a cleaning condition under which cleaning is performed by transferring an untransferred image on the intermediate transfer member to the image bearing members at the primary transfer portions without activating the intermediate transfer member cleaning apparatus at the time of start of the cleaning sequence and then activating the intermediate transfer member cleaning apparatus, and a cleaning condition under which the untransferred image on the intermediate transfer member is cleaned only with the intermediate transfer member cleaning apparatus.

By preparing multiple case-specific cleaning sequences in this manner, a cleaning time is shortened and a time necessary for recovery from a jam and an emergency stop of the image forming apparatus is shortened.

Also, when an elastic intermediate transfer belt including at least one elastic layer is used as the intermediate transfer member, it becomes possible to form a high-quality image in which no hollow character occurs, improve transfer efficiency, reduce the amount of transfer residual toner, and improve a transfer property with respect to thick paper and a transfer property with respect to paper including projections and depressions.

Further, when an electrostatic fur brush cleaning apparatus is used as the intermediate transfer member cleaning apparatus, a load placed on the intermediate transfer belt becomes small as compared with a case of the blade method, which is effective also for the elastic intermediate transfer belt.

Still further, by constructing the intermediate transfer member cleaning apparatus using at least a first cleaning portion and a second cleaning portion and by respectively applying biases having different polarities to the first cleaning portion and the second cleaning portion, it becomes possible to perform attraction and removal with reliability regardless of the polarity (positive or negative) to which the untransferred toner on the intermediate transfer member has been charged due to a bias applied at the secondary transfer portion, a use environment, toner degradation, and the like.

More specifically, the first cleaning portion removes a great majority of the transfer residual toner by having a reversed polarity through application of the same polarity as the charging characteristic of the toner to the first cleaning portion. On the other hand, the second cleaning portion cleans only transfer residual toner, which has not been attracted at the first cleaning portion and has passed through the first cleaning portion, that is, transfer residual toner having the same polarity as the cleaning apparatus. With this construction, it becomes possible to favorably clean transfer residual toner having both polarities. Also, it becomes possible to clean even toner that is not charged and remains on the intermediate transfer belt, which is hard to be electrostatically cleaned, through attraction by means of a mechanical rubbing force of the fur brush at the first cleaning portion or the second cleaning portion or through attraction at the second cleaning portion by means of charges injected by the cleaning member.

This application claims priority from Japanese Patent Application No. 2004-306263 filed on Oct. 20, 2004, which is hereby incorporated by reference herein.

What is claimed is:

1. An image forming apparatus comprising:

an image bearing member for bearing a toner image;

a cleaning member configured to remove residual toner on said image bearing member;

an intermediate transfer member onto which the toner image borne on the image bearing member is primarily transferred;

a primary transfer member to which a primary transfer voltage is applied to primarily transfer the toner image borne on the image bearing member onto the intermediate transfer member at a primary transfer portion;

a secondary transfer member which secondarily transfers the toner image borne on the intermediate transfer member onto a recording material at a secondary transfer portion;

a toner removing device which removes residual toner on the intermediate transfer member; and selecting means for selecting a performing means to (i) perform a first mode or (ii) perform a second mode, wherein said first mode is operable to remove the residual toner on the intermediate transfer member by the toner removing device and to transfer the residual toner on the intermediate transfer member onto said image bearing member by applying a voltage of a reverse polarity to a polarity of a primary transfer voltage to the primary transfer member and remove the residual toner on said image bearing member by said cleaning member, and wherein said second mode is operable to remove the residual toner on the intermediate transfer member by the toner removing device without passing the residual toner on the intermediate transfer member through the primary transfer portion, in accordance with an amount per unit area of the residual toner on the intermediate transfer member when the intermediate transfer member is stopped before the toner image primarily transferred on the intermediate transfer member arrives at the secondary transfer portion.

2. An image forming apparatus according to claim 1, wherein:

the first mode is operable to remove the residual toner on the intermediate transfer member by the toner removing device after transferring the residual toner on the intermediate transfer member through the primary transfer portion in a state in which the voltage of the reverse polarity to the polarity of the primary transfer voltage is applied to the primary transfer member, and the second mode is operable to remove the residual toner on the intermediate transfer member by the toner removing device without passing the residual toner on the intermediate transfer member through the primary transfer portion, in accordance with a position of the toner image existing on the intermediate transfer member when the intermediate transfer member is stopped.

3. An image forming apparatus according to claim 1, wherein the toner removing device includes a brush member to which a voltage is applied.

4. An image forming apparatus according to claim 1, wherein, when the amount per unit area is larger than a predetermined value, said selecting means selects the first mode.

5. An image forming apparatus according to claim 1, wherein, when the amount per unit area is equal to or less than a predetermined value, said selecting means selects the second mode.

6. An image forming apparatus according to claim 1, wherein the toner removing device removes the residual toner on the intermediate transfer member after transferring the residual toner on the intermediate transfer member through the primary transfer portion in a state in which the voltage of the reverse polarity to the polarity of the primary transfer voltage is applied to the primary transfer member.

* * * * *